US007609983B2

(12) United States Patent
Kinoshita et al.

(10) Patent No.: US 7,609,983 B2
(45) Date of Patent: Oct. 27, 2009

(54) IMAGE FORMING APPARATUS AND SHEET HEATING APPARATUS

(75) Inventors: Hidehiko Kinoshita, Kashiwa (JP); Jun Yamaguchi, Toride (JP); Atsushi Nakagawa, Toride (JP); Masaaki Moriya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 620 days.

(21) Appl. No.: 11/531,034

(22) Filed: Sep. 12, 2006

(65) Prior Publication Data

US 2007/0059057 A1 Mar. 15, 2007

(30) Foreign Application Priority Data

Sep. 13, 2005 (JP) ..... 2005-265571

(51) Int. Cl.
*G03G 15/00* (2006.01)
*G03G 15/20* (2006.01)

(52) U.S. Cl. ..... 399/19; 399/341

(58) Field of Classification Search ..... 399/19, 399/20, 21, 67, 68, 322, 341, 405, 407
See application file for complete search history.

(56) References Cited

U.S. PATENT DOCUMENTS

| | | | | |
|---|---|---|---|---|
| 6,512,914 | B2 | 1/2003 | Kabashima | 399/341 |
| 6,853,832 | B2 | 2/2005 | Noya et al. | 399/328 |
| 7,536,118 | B2 * | 5/2009 | Sippel et al. | 399/18 |
| 2006/0131301 | A1 | 6/2006 | Ohta et al. | 219/619 |
| 2006/0157475 | A1 | 7/2006 | Nishihara et al. | 219/619 |
| 2007/0025751 | A1 * | 2/2007 | Nakagawa et al. | 399/68 |
| 2007/0053708 | A1 * | 3/2007 | Mori et al. | 399/69 |
| 2007/0053731 | A1 * | 3/2007 | Mori et al. | 399/341 |
| 2007/0166086 | A1 * | 7/2007 | Toyohara et al. | 399/341 |

FOREIGN PATENT DOCUMENTS

| | | | |
|---|---|---|---|
| EP | 0 301 585 | | 2/1989 |
| JP | 63-106253 | | 5/1988 |
| JP | 64-35452 | | 2/1989 |
| JP | 01226650 | A * | 9/1989 |
| JP | 4-362679 | | 12/1992 |
| JP | 5-216322 | | 8/1993 |
| JP | 5-216580 | | 8/1993 |
| JP | 8-272159 | | 10/1996 |
| JP | 9-43912 | | 2/1997 |
| JP | 9-244482 | | 9/1997 |
| JP | 11-327220 | | 11/1999 |
| JP | 2002-214948 | | 7/2002 |
| JP | 2003-84477 | | 3/2003 |
| JP | 2004-151200 | | 5/2004 |
| JP | 2005099759 | A * | 4/2005 |

* cited by examiner

*Primary Examiner*—Robert Beatty
(74) *Attorney, Agent, or Firm*—Fitzpatrick, Cella, Harper & Scinto

(57) ABSTRACT

When an abnormality factor occurs in a second heating device, a sheet located upstream of a branch portion is discharged onto a discharge tray through a second conveying path. After the abnormality factor in the second heating device is removed and the sheet discharged to the discharge tray through the second conveying path is set in a paper refeeding tray, a sheet feeding portion feeds the sheet set in the paper refeeding tray to the second heating device.

13 Claims, 17 Drawing Sheets

IMAGE FORMING APPARATUS AND SHEET HEATING APPARATUS

BACKGROUND OF THE INVENTION

1. Field of the Invention

The present invention relates to an image forming apparatus and a sheet heating apparatus.

2. Description of the Related Art

In the past, there have been widely known image forming apparatuses using an electrophotographic method, such as copying machines, printers, etc., and there have been commercialized a lot of image forming apparatuses which perform image formation not only in black and white but also in full color.

In addition, requests for the quality of images also become more and more sophisticated in accordance with the increasing use of electrophotographic image forming apparatuses in a variety of fields, too. Here, as one of the factors for determining the image quality, in particular the glossiness of full color images, there is pointed out the smoothness of output images.

In response to such a need, for example, Japanese patent application laid-open No. S64-35452 and Japanese patent application laid-open No. H5-216322 disclose image forming methods, respectively, in which a color toner made of a thermoplastic resin is transferred to a recording material on which a transparent resin layer made of a thermoplastic resin is formed, and then a color image is formed on the recording material by heating and melting the color toner. Additionally, in these image forming methods, a belt fixing unit is proposed as a preferable fixing method.

As such a belt fixing unit, there have been known ones that are described, for example, in Japanese patent application laid-open No H5-216580 and Japanese patent application laid-open No. H4-362679. The belt fixing units as described in these Japanese patent application laid-open Nos. H5-216580 and H4-362679 adopt a construction that a recording material carrying thereon an unfixed toner image is pressed and heated by the fixing belt composed of a heat resisting film, and the toner image is cooled to be solidified while keeping the recording material in intimate contact with the fixing belt, after which the recording material with the toner image fixed thereto is released from the fixing belt.

Accordingly, the toner image and the transparent resin layer on the surface of the recording material with the toner image being fixed while being embedded in the transparent resin layer of the recorder material are solidified along the surface configuration of the belt to provide a smooth entire surface of the recording material. As a result, the color image excellent in luster can be obtained (Japanese patent application laid-open No. 2004-151200 and Japanese patent application laid-open No. 2002-214948).

In addition, as such recording materials each having a resin layer for use with image forming apparatuses, there have been proposed a variety of recording materials, as described in Japanese patent application laid-open No. 2003-84477. In this Japanese patent application laid-open No. 2003-84477, an electrophotographic transfer sheet is proposed which is coated with a resin layer of a thickness of about 10 μm comprising, as a principle component, a thermoplastic resin having a glass-transition temperature of 85 C. or less.

A recording material with a resin layer as referred to above is very expensive in comparison with ordinary plain paper. Accordingly, in case where abnormality occurs in such an apparatus, repeating a copying operation after removal of all the recording materials in the apparatus as in the past causes a problem that leads to an increase in the running cost thereof.

In addition, in Japanese patent application laid-open No. H9-43912, Japanese patent application laid-open No. H8-272159 and Japanese patent application laid-open No. H11-327220, there have been disclosed apparatuses each including two image forming portions, i.e., a first image forming portion and a second image forming portion that is arranged at a downstream side of the first image forming portion. In particular, Japanese patent application laid-open No. H11-327220 describes that when a jam occurs at any location in either of the downstream second image forming portion and a downstream second fixing unit, a sheet material to be subsequently conveyed is switched into a second conveying path through which it is discharged to a tray that is arranged outside or inside the apparatus.

SUMMARY OF THE INVENTION

The object of the present invention is to provide an image forming apparatus and a sheet heating apparatus which are capable of reducing running costs without performing unnecessary processes on sheets upon occurrence of an abnormality in either of the apparatus or the device.

In order to achieve the above-mentioned object, an image forming apparatus according to one aspect of the present invention includes:

- a first heating device which heats a sheet with a toner image formed thereon;
- a second heating device which heats said sheet heated by said first heating device;
- a first conveying path which conveys said sheet conveyed from said first heating device to said second heating device;
- a second conveying path which branches from said first conveying path at a branch portion upstream of said second heating device in said first conveying path for conveyance of said sheet without conveying it to said second heating device;
- a discharge tray to which said sheet being conveyed on said second conveying path is discharged;
- a feeding portion which feeds sheets put on a paper refeeding tray; and
- a feeding conveying path which conveys a sheet fed by said feeding portion to said second heating device, said feeding conveying path having a downstream portion merged into said first conveying path at a location between said first heating device and said second heating device;
- wherein when an abnormality factor occurs in said second heating device, a sheet located upstream of said branch portion in said first conveying path is discharged to said discharge tray through said second conveying path; and
- an annunciation portion is provided which serves to inform that said sheet discharged to said discharge tray should be set in said refeeding tray when said sheet has been discharged to the discharge tray upon occurrence of the abnormality factor in said second heating device.

In addition, an image forming apparatus according to another aspect of the present invention includes:

- a first heating device which heats a sheet with a toner image formed thereon;
- a second heating device which heats said sheet heated by said first heating device;
- a first conveying path which conveys said sheet conveyed from said first heating device to said second heating device;

a second conveying path which branches from said first conveying path at a branch portion upstream of said second heating device in said first conveying path for discharging said sheet without conveying it to said second heating device;

a discharge tray to which said sheet being conveyed on said second conveying path is discharged;

a feeding portion which feeds sheets put on a paper refeeding tray; and a feeding conveying path which conveys a sheet fed by said feeding portion to said second heating device, said feeding conveying path having a downstream portion merged into said first conveying path at a location between said first heating device and said second heating device;

wherein when abnormality factor occurs in said second heating device, a sheet existing between said branch portion and said second heating device in said first conveying path is conveyed upstream of said branch portion, and the sheet thus conveyed upstream of said branch portion is discharged onto said discharge tray through said second conveying path.

Moreover, a sheet heating apparatus according to a further aspect of the present invention includes:

a first conveying path which conveys a sheet being conveyed from an image forming apparatus main body that includes an image forming portion for forming a toner image on said sheet and a heating device for heating said sheet having said toner image formed thereon by means of said image forming portion;

a second heating device which heats said sheet being conveyed on said first conveying path;

a second conveying path which branches from said first conveying path at a branch portion upstream of said second heating device in said first conveying path for discharging said sheet without conveying it to said second heating device;

a discharge tray to which said sheet being conveyed on said second conveying path is discharged;

a feeding potion which feeds sheets put on a paper refeeding tray; and a feeding conveying path which conveys a sheet fed by said feeding portion to said second heating device, said feeding conveying path having a downstream portion merged into said first conveying path at a location between said first heating device and said second heating device;

wherein when an abnormality factor occurs in said second heating device, a sheet located upstream of said branch portion is discharged onto said discharge tray through said second conveying path; and after the abnormality factor in said second heating device is removed and the sheet discharged to said discharge tray through said second conveying path is set in said paper refeeding tray, said sheet feeding portion feeds the sheet set in said paper refeeding tray to said second heating device.

DESCRIPTION OF THE EMBODIMENTS

Hereinafter, preferred embodiments of the present invention will be described in detail while referring to the accompanying drawings. In all the figures of the following embodiments, the same symbols are attached to the same or corresponding portions or elements.

Figure 1:
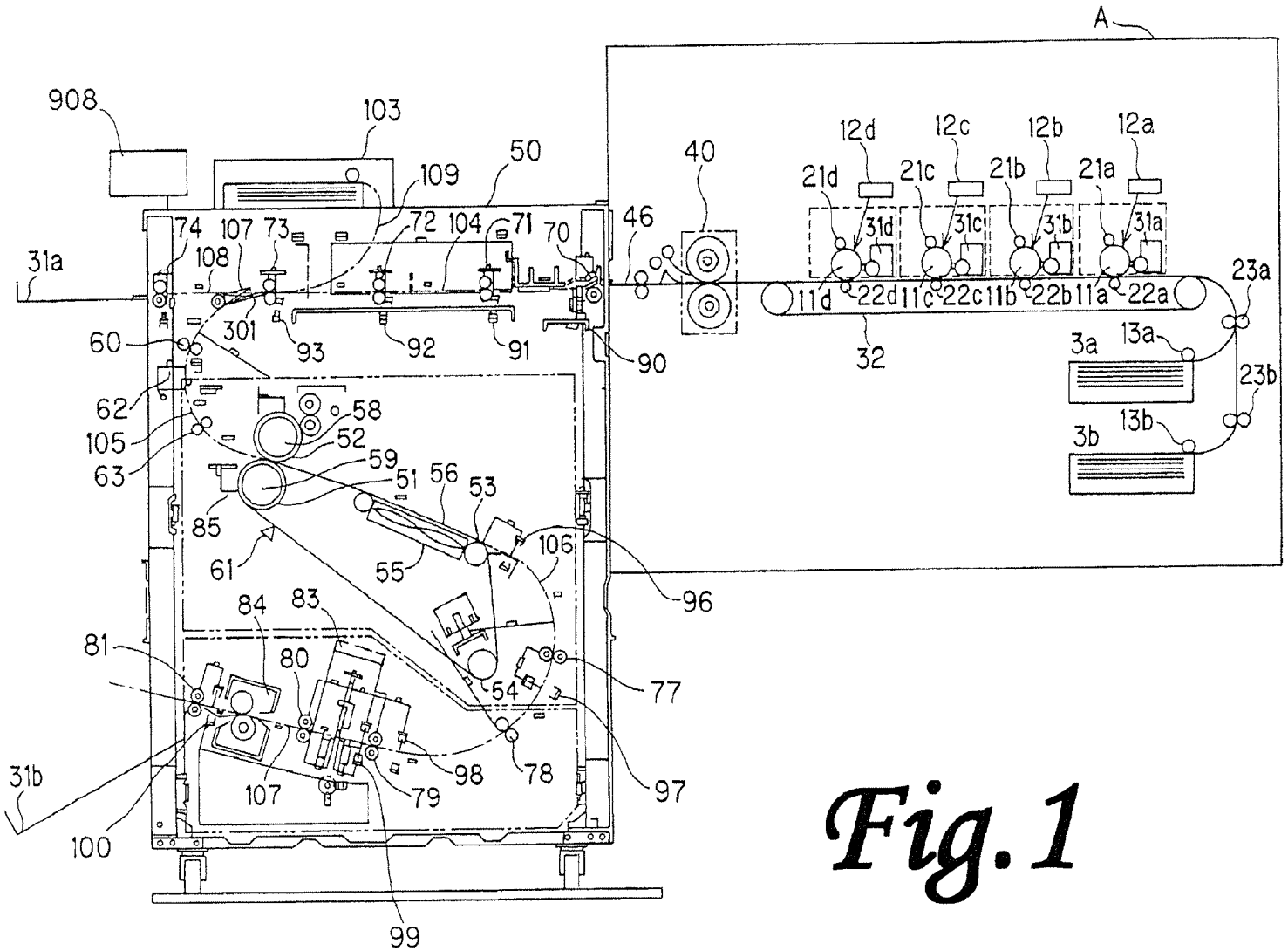
FIG. 1 is a cross sectional view showing the construction of an image forming apparatus according to a first embodiment of the present invention.

In FIG. 1, there is shown an image forming apparatus that is provided with a fixing device (sheet heating apparatus).

A main body A of the image forming apparatus is a color recording device of a tandem type for transferring a toner image onto a recording material P in the form of a sheet. The image forming apparatus main body A transfers the toner image to the recording material in the form of recording paper P at respective color stations in a sequential manner thereby to form a colored toner image on a recording paper. That is, as an image forming portion, there are provided four transfer units that form four colors comprising black BK, cyan C, magenta M and yellow Y, respectively, on the recording paper P. These transfer units are constructed in such a manner that it includes photosensitive drums 11*a* through 11*d*, exposure devices 12*a* through 12*d*, chargers 21*a* through 21*d*, development units 31*a* through 31*d*, and transfer rollers 22*a* through 22*d*, respectively. In addition, pieces of recording paper P on which an image is to be formed are loaded and received in cassettes 3*a*, 3*b*, carried out by pickup rollers 13*a*, 13*b*, and conveyed onto an endless belt 32 by conveyance rollers 29*a*, 23*b*.

Also, a piece of recording paper P is heated by a first heating device in the form of a fixing unit 40, whereby the toner image formed on the recording paper P is fixed to the recording paper P. In the image forming apparatus, a mode A (plain paper recording mode) and a mode B (photograph mode) can be selectively set as a setting.

(Mode A (Plain Paper Recording Mode))

In the node A, a recording paper P1 (e.g., plain paper of 81 g/m$^3$) provided in a sheet feeder is fed from the sheet feeder, and a toner image is transferred to the recording paper P1 and fixed thereto by heating the sheet or recording material by means of the first heating device in the form of the fixing unit 40. Thereafter, the recording material P with the toner image fixed thereto is conveyed to a sheet heating apparatus in the form of a fixing unit 50 while passing through a conveying path 46. Also, the recording paper P is driven to successively pass through a common path in the form of a conveying path 104 by means of conveyance roller pairs 70, 71, 72, 73. The recording paper P after passage through the common path is switched by a switching portion in the form of a flapper 107, so that it is conveyed through a second conveying path in the form of a discharging conveying path 108, and discharged to a discharge tray 31*a* by means of a discharge roller pair 74.

(Mode B (Photograph Mode))

On the other hand, in the mode B, a recording paper P provided in the sheet feeder is supplied and a toner image is transferred thereto. Thereafter, the sheet or recording material P is passed through the fixing unit 40, and then conveyed to the fixing unit 50 while passing through the conveying path 46. The recording paper P successively is passed through the conveying path 104 by means of the conveyance rollers 70, 71, 72, 73, and is conveyed, by switching of the flapper 107, to a conveying path 105 which constitutes a part of the first conveying path. Thereafter, a fixing process is performed by a fixing belt 56 which constitutes a part of a second heating device. Subsequently, the recording material P passes through the conveying path 106 as a part of the first conveying path, so that predetermined processes are successively carried out on the recording material P by means of cutters 83, 84, and the recording material P thus processed is discharged to a discharge tray 31*b*.

Figure 2:
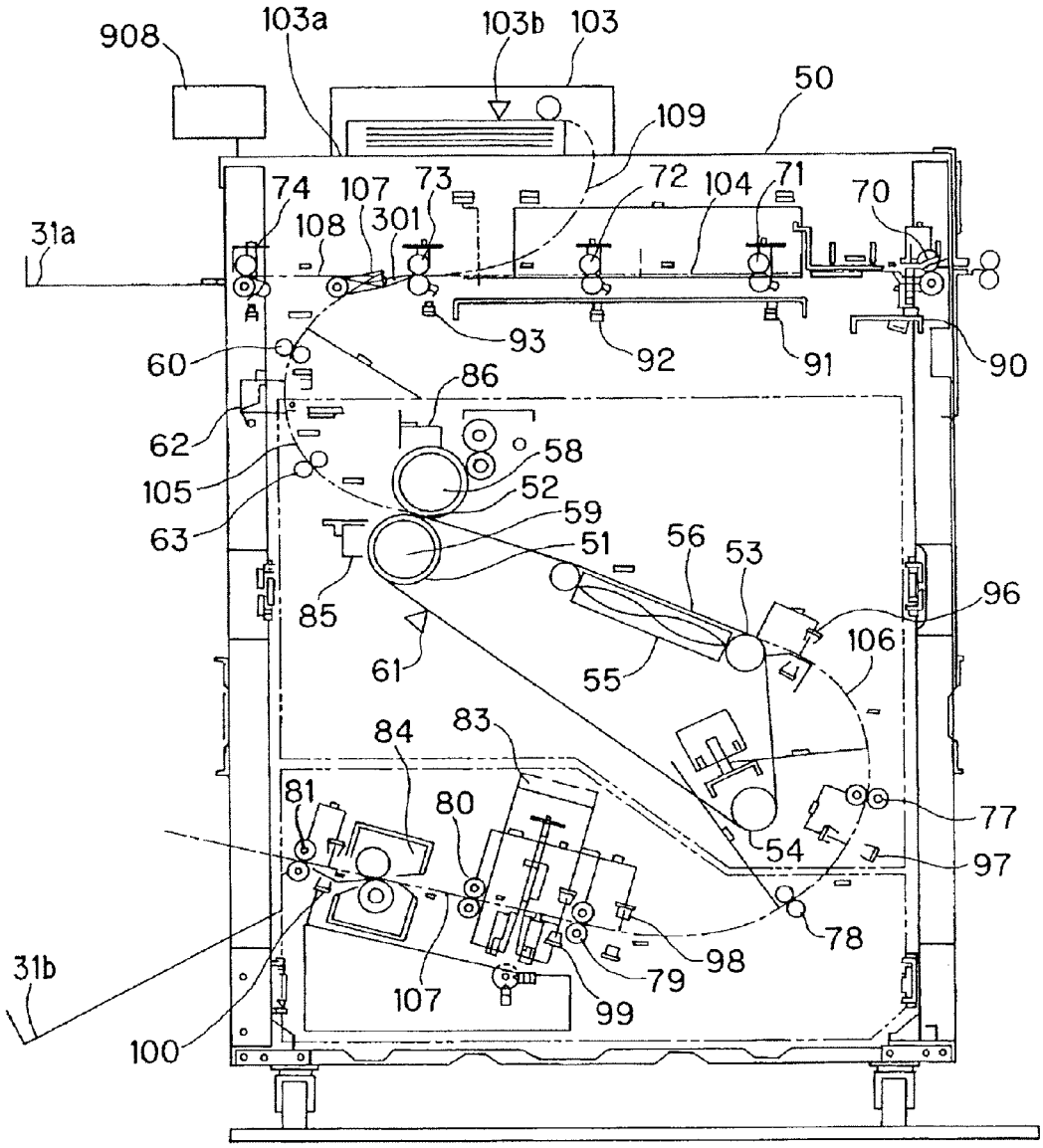
FIG. 2 is a cross sectional view showing the construction of a fixing device according to the first embodiment of the present invention.

In addition, the fixing unit 50, which constitutes the sheet heating apparatus according to the first embodiment of the present invention, is shown in FIG. 2. The fixing unit 50 is a device that reheats a sheet heated by the fixing unit 40 of the image forming apparatus main body A and then cools it to give luster to an image on the sheet. As already stated, the fixing unit 50 is provided with the conveying path 104 on which the sheet having passed the conveying path 46 of the image forming apparatus is conveyed. The conveyance rollers 71, 72, 73 are arranged on the conveying path 104 which is connected at its downstream side with a conveying path 105. A pair of conveyance rollers 60 and a pair of registration rollers 63 are arranged on the conveying path 105. Conveyance roller pairs 77, 78 are arranged on the conveying path 106 at locations downstream of the fixing belt 56. The conveying path 106 is connected at its downstream side with a cutting conveying path 107, on which are arranged conveyance roller pairs 79, 80 and a discharge roller pair 81.

Optical sensors 90, 91, 92, 62, 96, 97, 98, 99, 100 are arranged in the conveying paths 104, 105, 106, 107 in this order from an upstream side to a downstream side thereof. The optical sensors 90, 91, 92, 93, 62, 96, 97, 98, 99, 100 are sensors that serve to detect the presence or absence of a recording paper in the conveying paths 104, 105, 106, 107. The optical sensors 90, 91, 92, 93, 62, 96, 97, 98, 99, 100 are used for controlling the conveyance and stopping of the recording paper, as well as for detecting whether there is abnormality in the conveyance of the recording paper.

A branch portion 301 is arranged at a boundary between the conveying path 104 and the conveying path 105. At the branch portion 301, the second conveying path in the form of the discharging conveying path 108 branches from the first conveying path including the conveying path 104 and the conveying path 106. The discharging conveying path 108 is a conveying path that serves to discharge a sheet or recording material onto the discharge tray 31*a* arranged outside the apparatus. The flapper 107, being free to swing, is arranged at the branch portion 301.

The fixing unit 50 is provided with a sheet feeding portion in the form of a paper refeeding unit 103, on which the sheet discharged to the discharge tray 31*a* is put again. The paper refeeding unit 103 is a device that serves to feed the sheet thus put thereon to the conveying path 104, i.e., to the later-mentioned second heating device. The paper refeeding unit 103 is provided with a paper refeeding tray 103*a*. The sheet fed by the paper refeeding unit 103 is conveyed on the feeding conveying path 109, which merges into the conveying path 104 at a location upstream of the second heating device. That is, the feeding conveying path 109 is connected at its downstream side with the conveying path 104.

As shown in FIG. 2, the fixing unit 50 according to this first embodiment is constructed in such a manner that it includes a fixing roller 51, a pressure roller 52, a rotating roller 53 and a tension roller 54 which together constitute the second heating device, a cooling portion in the form of a cooling fan 55, and an endless belt in the form of a fixing belt 56 wrapped around these rollers and the belt. Further, provision is made for a sensor 61 that detects the position of a recording paper P on the fixing belt 56, a registration sensor 62 that detects the leading end of the recording paper P, and a pair of registration rollers 63.

Roller heating heaters 59, 58, each of which constitutes a heating portion, are arranged in the fixing roller 51 and the pressure roller 52, respectively. In these roller heating heaters 58, 59, thermal management is carried out by means of temperature sensors 85, 86 each comprising a thermistor for example.

The fixing roller 51 has a concentric three-layer structure including a core portion, an elastic layer, and a mold release layer. The core portion of the fixing roller 51 is formed of a hollow aluminum pipe of 44 mm in diameter and 5 mm in thickness. In addition, a heat source in the form of a halogen lamp is arranged in the hollow pipe of the core portion. The elastic layer is made of silicone rubber of 50 degrees in JIS A hardness and 3 mm in thickness. The mold release layer is made of PFA of 50 μm in thickness. Also, a similar construction is adopted in the pressure roller 52.

In addition, the fixing belt 56 is constructed in a two-layer structure comprising a mold release layer like a mirror finished surface formed on a surface (front surface) which is in abutment with the recording paper P and the pressure roller 52, and a base layer or member formed on a surface (rear surface) which is in abutment with the fixing roller 51. The mold release layer is made of PFA of 10 μm in thickness, and the base layer is formed of a belt comprising a stainless sheet of 100 μm in thickness with its opposite ends being connected with each other in an endless manner.

The cooling fan 55 is arranged at an inner side of the fixing belt 56 for blowing air flow in a direction orthogonal to the plane of a sheet. The cooling fan 55 cools the recording paper that is conveyed by the fixing belt 56 and heated by the roller heating heaters 59, 58.

A predetermined tension is provided to the fixing belt 56 by means of the tension roller 54 so that the fixing roller 51 is driven to rotate in a right rotational direction in FIG. 2, whereby the fixing belt 56 is rotated. As a result, the curvature of the fixing belt 56 in the cooling portion is held at a substantially prescribed curvature by the rigidity of the fixing belt 56 itself.

In addition, electric power is supplied to the roller heating heaters 58, 59 comprising the halogen lamps arranged in the fixing roller 51 and the pressure roller 52, respectively, whereby the surface temperatures of the fixing roller 51 and the pressure roller 52 are raised.

Now, the construction of the recording paper P will be described. Specifically, the recording paper used in this first embodiment is constructed to include a base material or substrate having a pigment coated layer formed on a least one surface thereof, and a resin layer formed on the pigment coated layer. The pigment coated layer is composed of a bonding material and pigments as its principal components, and the resin layer is composed of a thermoplastic resin as its principal component.

Though the resin layer contains the thermoplastic resin and a thermosetting resin as its principal components, it may be a mixed resin layer comprising a thermoplastic resin and a thermosetting resin mixed with each other. Also, the resin layer can be formed of a plurality of layers including a thermoplastic resin layer composed of a thermoplastic resin as its principal component and a thermosetting resin layer composed of a thermosetting resin as its principal component.

In case where the resin layer is formed of the plurality of layers, it is preferable that the thermosetting resin layer composed of the thermosetting resin as its principal component be arranged as a top or uppermost layer. Further, the resin layer can also be of a layer construction comprising these mixed resin layer, thermoplastic resin layer and thermosetting resin layer combined with one another. In this case, it is preferable that the top or upper most layer be a layer including a thermosetting resin such as a mixed resin layer, a thermosetting resin layer, or the like. A polyester resin, a styrene acrylic ester, a styrene methacrylic acid ester, or the like, can be used as the thermoplastic resin, but in particular, it is preferable to use a polyester resin.

The cutters 83, 84 for cutting out the recording paper conveyed on the cutting conveying path 107 are arranged at locations downstream of the fixing belt 56.

The fixing unit 50 is provided with a display device 908 for informing a user of operations of the apparatus.

(Control of the Fixing Unit)

Figure 3:
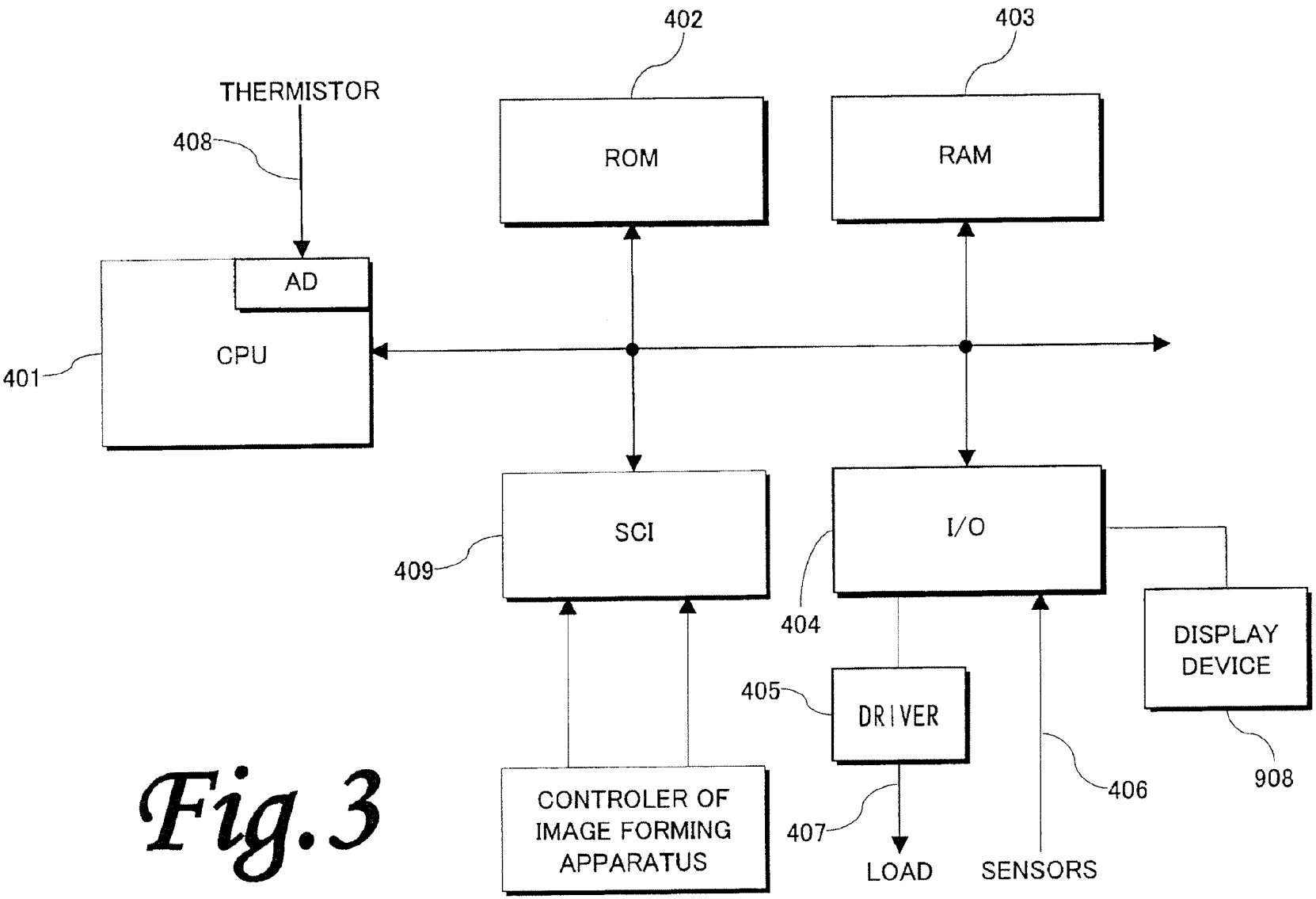
FIG. 3 is a block diagram showing the construction of a controller that controls the fixing device in the image forming apparatus.

Next, reference will be made to the control of the fixing unit according to the first embodiment of the present invention. In FIG. 3, there is shown a block diagram of performing the control of the fixing unit 50 according to this first embodiment. In FIG. 3, a CPU 401 is a processing circuit for executing mechanical control on the fixing unit 50, and performs a control operation according to programs stored in a ROM 402. A RAM 403 is a rewritable storage portion that is used by the CPU 401. A variety of kinds of sensors 406 generate output signals which are read into the CPU 401 through an I/O port 404. The variety of kinds of sensors 406 also include the optical sensors 90, 91, 92, 93, 62, 96, 97, 98, 99, 100 that detect the presence or absence of a recording paper, and a presence or absence detecting sensor 103*b*.

The optical sensors 62, 90 through 93 and 96 through 100 are sensors that serve to detect whether there is a recording paper at individual locations in the conveying path along which the optical sensors are arranged. The signals from the optical sensors 62, 90 through 93 and 96 through 100 are transmitted to the CPU 4 1 through the I/O port 404. For example, the CPU 401 monitors, based on the signals from these optical sensors 62, 90 through 93 and 96 through 100, whether an interval or timing from a leading end to a trailing end of the recording paper is within a certain predetermined interval. In other words, the CPU 401 detects, based on the signals from the optical sensors 62, 90 through 93 and 96 through 100, that an abnormality in the conveyance of the recording paper has occurred.

For example, in case where after detection of the passage of the recording paper by a certain optical sensor, another optical sensor immediately downstream of the preceding optical sensor does not detect the leading end of the recording paper within a predetermined time, the CPU 401 determines that a delay jam has occurred. Here, note that similarly, in case where a recording paper P remains in the conveying paths 104, 105, 106 of the fixing unit when the power is turned on in the fixing unit, such an event is detected by the optical sensors 62, 90 through 93 and 96 through 100, and the CPU 401 determines that the fixing unit is abnormal.

In addition, when the recording paper detecting time by these optical sensors 62, 90 through 93 and 96 through 100 for detecting the recording paper P is longer than the predetermined time, the CPU 401 determines that a stay jam has occurred.

The I/O port 404 is connected to a driver 405. An output from the I/O port 404 is converted into a necessary drive voltage and supplied to a variety of kinds of loads 407. Each of the loads 407 includes a paper feed motor for driving the fixing heater and the conveyance rollers and a motor, a clutch, a solenoid and so on for cutting out the recording paper P. The loads 407 also include a solenoid that operates the flapper 107. The I/O port 404 is connected to the display device 908. The CPU 401 can control the display of the display device 908. A serial communication interface (SCI) 409 is an interface that serves to send and receive information between the CPU 401 and a control portion of the image forming apparatus. The control portion of the image forming apparatus is a controller that serves to control the image forming apparatus main body A.

Further, the temperature sensors 85, 86 (see FIG. 1 and FIG. 2) for detecting the temperatures of the fixing roller 51 and the pressure roller 52, respectively, in the fixing unit 50 are connected to an A/D input of the CPU 401. The CPU 401 controls the fixing heater in accordance with the detected temperature data from the temperature sensors 85, 86 connected to the A/D input.

(Image Forming Operation)

Next, reference will be made to the image forming operation of the fixing unit according to this first embodiment of the present invention.

First of all, a recording paper P output from the image forming apparatus main body A is conveyed to the fixing unit 50 wherein the recording material P is driven to successively pass through the conveying path 104 by means of conveyance rollers 70, 71, 72, 73. The recording paper P thus having passed through the conveying path 104 is guided to the conveying path 105 by the flapper 107, and is conveyed in the conveying path 105. Thereafter, the recording paper P passes the registration sensor 62, which is an optical sensor, and is stopped temporarily at the time when the leading end thereof is clamped by the registration roller pair 63. Here, note that at this time, the rotation of the fixing belt 56 is continued.

A desired position of the fixing belt 56 is detected by the sensor 61, and the registration roller pair 63 are started to rotate again in such a manner that the timing at which a recording paper adhering position HT on the fixing belt 56 arrives at a nip portion of the fixing belt 56 between the fixing roller 51 and the pressure roller 52 and the timing at which the leading end of the recording paper P arrives at a fixing nip portion are synchronized with each other. As the registration roller pair 63 starts rotating, the leading end of the recording paper P is sent to the fixing nip (a nip point between the fixing belt 56 and the pressure roller 52).

Figure 4B:
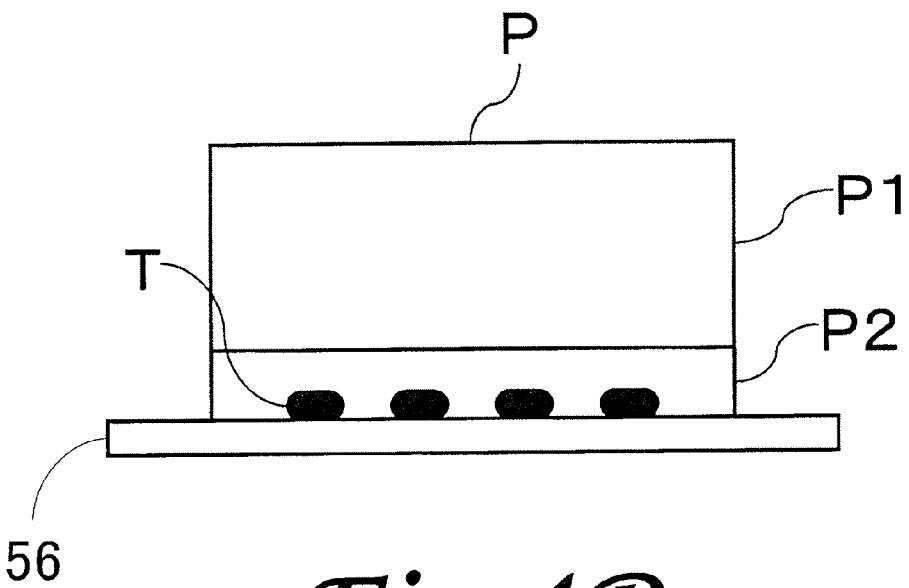
FIG. 4B is a view showing the state of the toner on the recording material after passage of a second fixing unit in the image forming apparatus.
Figure 4A:
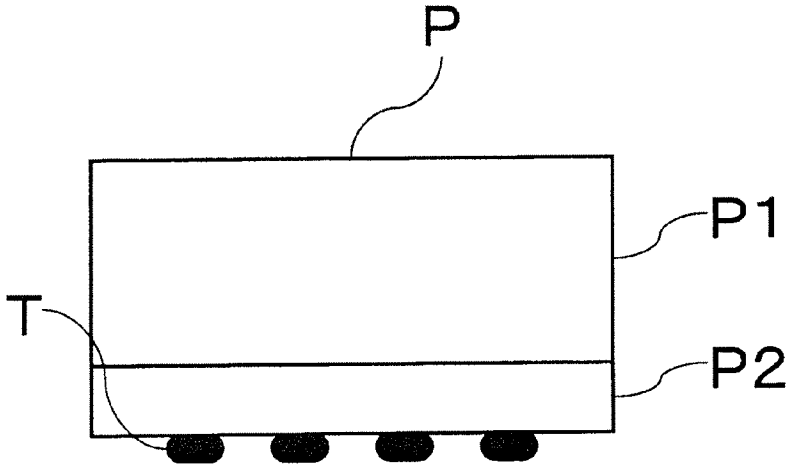
FIG. 4A is a view showing the state of a toner on a recording material after passage of a first fixing unit in the image forming apparatus.

Thereafter, the recording paper P passes through the pressure contact portions of the fixing belt 56 and the pressure roller 52. In this case, heat from the fixing roller 51 and the pressure roller 52 is applied to the recording paper P and a toner T on the recording paper P. Accordingly, the temperature of a transparent resin layer P2 in the recording paper P rises to soften the transparent resin layer P2, and the pressure by the fixing roller 51 and the pressure roller 52 is applied to the recording paper P. As a result, the toner image, which is in a state shown in FIG. 4A before passing through the pressure contact portions, is embedded into the transparent resin layer P2 of a high temperature on the recording paper P, as shown in FIG. 4B. At the same time, the recording paper P is placed into intimate contact with the surface of the fixing belt 56.

Thereafter, the recording paper P is conveyed to a cooling area in accordance with the rotation of the fixing belt 56 while being kept in intimate contact with the fixing belt 56. In the cooling area, the recording paper P is forcedly cooled in an efficient manner under the action of the cooling fan 55 and an airflow flowing in an air duct enclosing the cooling fan 55.

Figure 5:
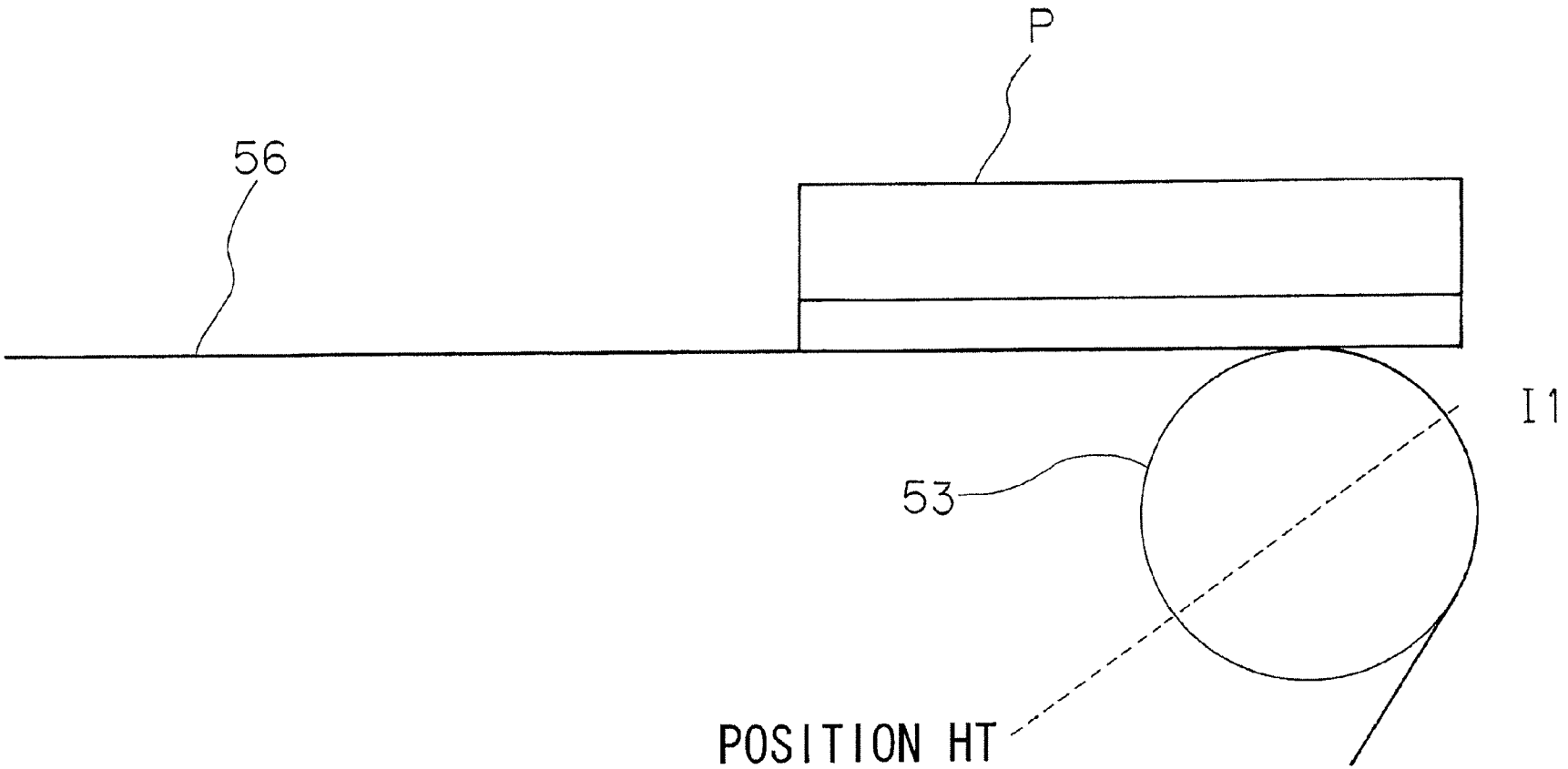
FIG. 5 is a view showing the timing at which the recording material is adhered to a fixing belt according the first embodiment of the present invention.

The recording paper P being placed in intimate contact with the surface of the fixing belt 56 is cooled in the cooling area, and as shown in FIG. 5, at a location at which the curvature of the fixing belt 56 is changed by the rotating roller 53, the recording paper P begins to peel off or separate, at its leading end, from the surface of the fixing belt 56 under the action of the rigidity of the recording paper P itself. In FIG. 5, the recording paper P is peeled or separated from a position HT in the rotating roller 53 and the fixing belt 56.

Then, as shown in FIG. 1, the recording paper P thus peeled or separated passes through the conveying path 106 and is cut out by the cutters 83, 84. Here, note that the recording paper P is cut at its upper and lower ends and at its right and left sides with a cutting length WT and a cutting width WY being shorter than the length and width of a margin area. Thereafter, the recording paper P is carried out to the discharge tray 31*b*.

(Image Forming Operation)

Figure 6:
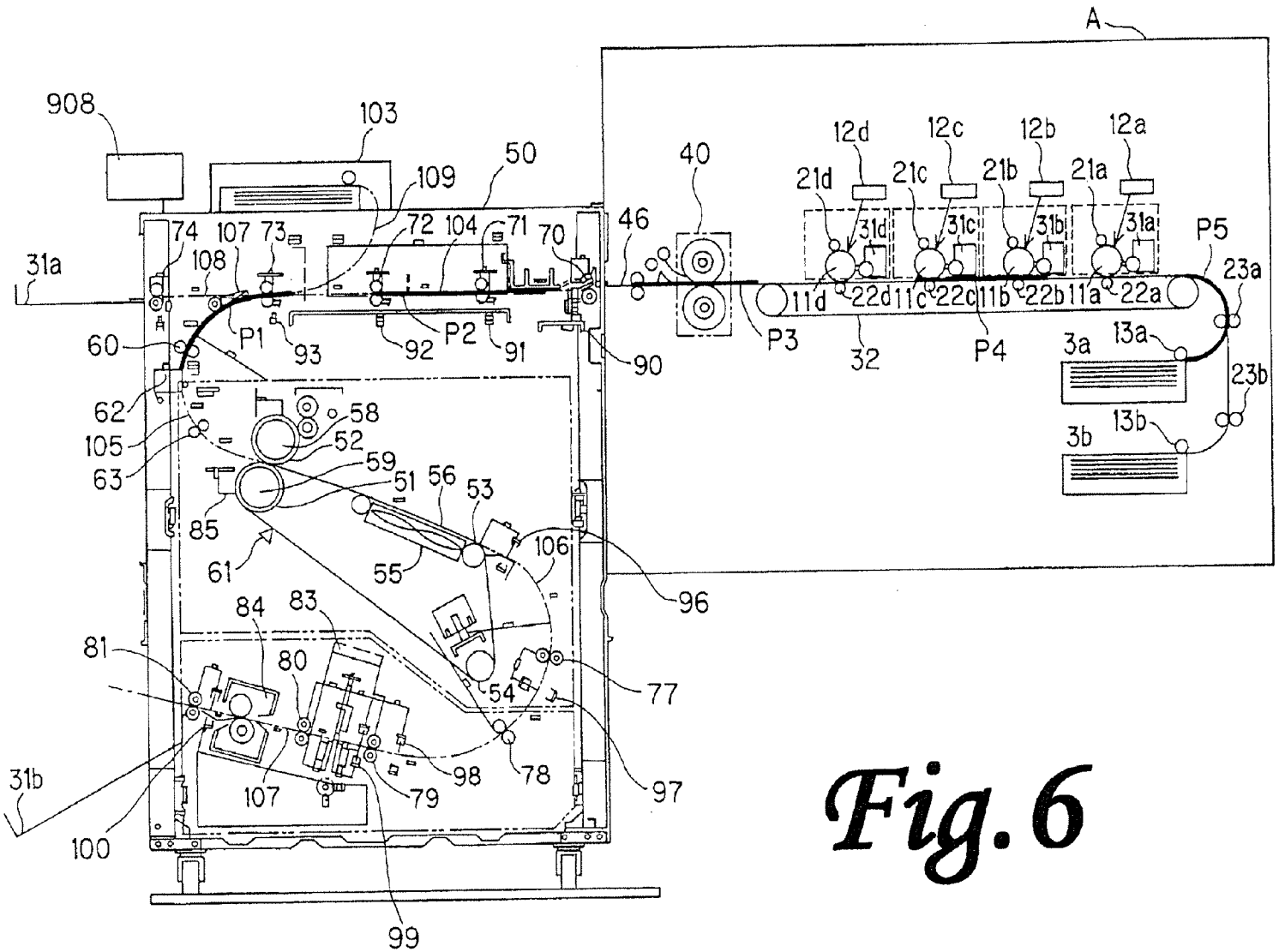
FIG. 6 is a view showing the conveyance sequence of the recording material at a normal time in the image forming apparatus according to the first embodiment of the present invention.

Next, reference will be made to a series of continuous operations of the image forming apparatus according to this first embodiment at a normal time thereof. Here, an exemplary case will be described in which an image is continuously output in five sheets of paper in a photograph mode. In FIG. 6, there is shown the state of conveyance of the recording paper P in the image forming apparatus according to this first embodiment.

As shown in FIG. 6, a first sheet P1 on which an image is formed by the image forming apparatus main body A is temporarily stopped based on the detection of its leading end by the registration sensor 62, which is an optical sensor, after having passed through the conveying paths 104, 105 according to a predetermined sheet conveyance sequence. At this time, a second sheet P2 is stopped at a location at which it is clamped by the conveyance rollers 72 based on the detection thereof by the optical sensor 92.

At this time, a third sheet P3 passes through the fixing unit 40 of the image forming apparatus main body A. Further, an image forming operation for a fourth sheet P4 is executed on the transfer belt, and a fifth sheet P5 is at a position fed from the sheet feeding portion. A desired position of the first sheet P1 on the fixing belt is detected by the sensor 61, and the registration roller pair 63 are restarted to rotate in such a manner that the timing at which the recording paper adhering position HT on the fixing belt 56 arrives at the nip portion of the fixing belt 56 between the fixing roller 51 and the pressure roller 52 and the timing at which the leading end of the first sheet P1 arrives at the fixing nip portion are synchronized with each other, whereby the first sheet P1 is conveyed into the fixing nip.

Thereafter, the first sheet P1 passes through the pressure contact portions of the fixing belt 56 and the pressure roller 52. In this case, the first sheet P1 and a toner T on the first sheet P1 are heated by the fixing roller 51 and the pressure roller 52, whereby the temperature of the transparent resin layer P2 in the first sheet P1 is raised to soften the transparent resin layer P2, and the pressure between the fixing roller 51 and the pressure roller 52 is applied to the first sheet P1. As a result, the toner image, which is in the state shown in FIG. 4A before passing through the pressure contact portions, is embedded into the transparent resin layer P2 of a high temperature on the first sheet P1, as shown in FIG. 4B. At the same time, the first sheet P1 is placed into intimate contact with the surface of the fixing belt 56.

Thereafter, the first sheet P1 is conveyed to a cooling area in accordance with the rotation of the fixing belt 56 while being kept in intimate contact with the fixing belt 56. In the cooling area, the first sheet P1 is forcedly cooled in an efficient manner under the action of the cooling fan 55 and the airflow flowing in then air duct enclosing the cooling fan 55. Here, note that this cooling fan 55 is constructed so as to be able to change the flow rate of the airflow. As a result, the flow rate of the airflow can be set in such a manner that the recording paper P on the fixing belt 56 can be easily separated therefrom.

In this manner, the first sheet P1 being placed in intimate contact with the surface of the fixing belt 56 is cooled in the cooling area to a sufficient extent, and is peeled off or separated, under the action of the rigidity of the first sheet P1, from the surface of the fixing belt 56 in an area in which the curvature of the fixing belt 56 is changed by the rotating roller 53.

In addition, as shown in FIG. 5 and FIG. 6, the first sheet P1 being conveyed while placed in intimate contact with the surface of the fixing belt 56 is started to peel off or separate therefrom at its leading end under the action of the rigidity of the first sheet P1 itself at the time when it arrives at the position HT.

Figure 7:
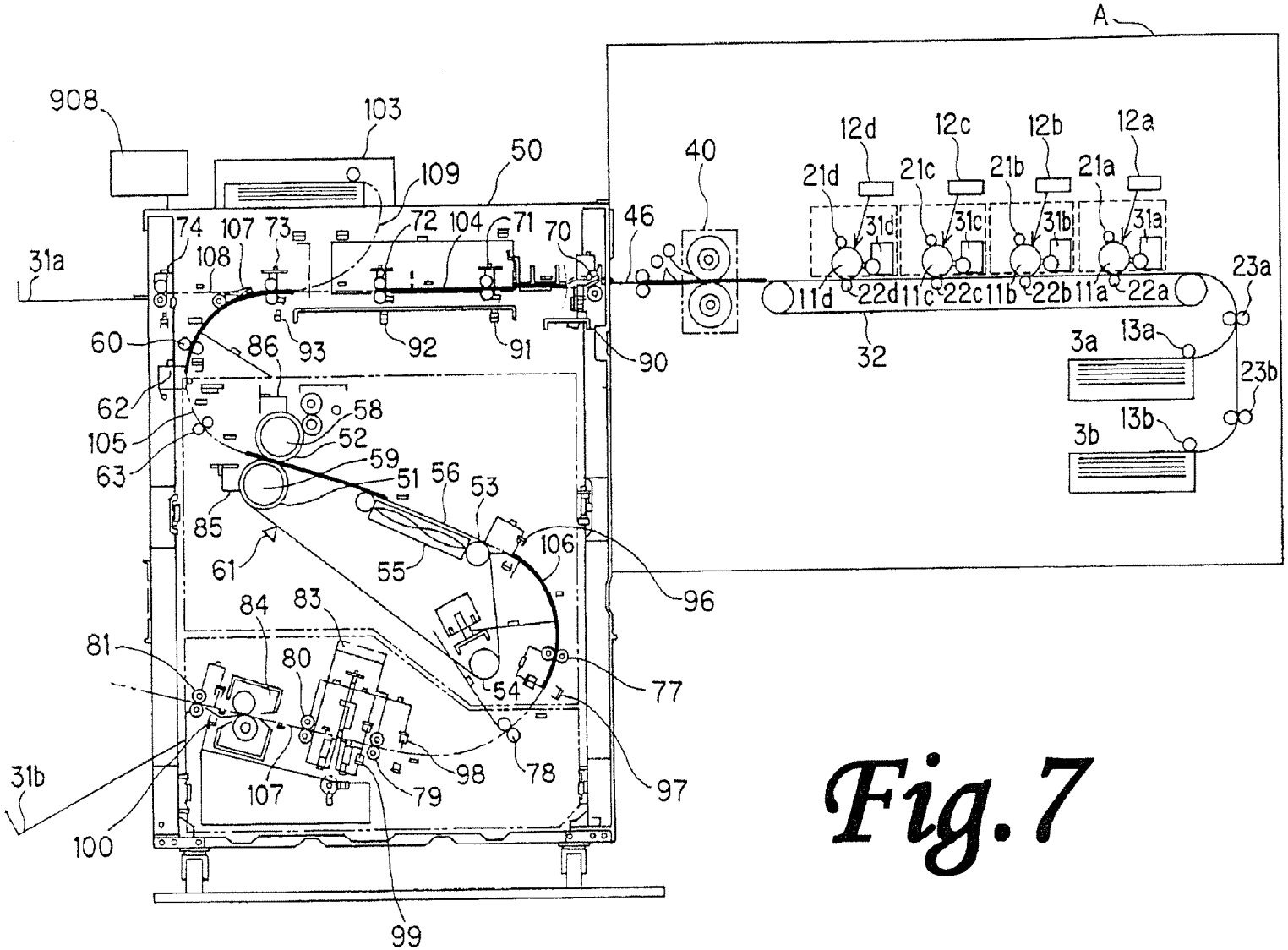
FIG. 7 is a view showing the conveyance sequence of the recording material at the normal time in the image forming apparatus according to the first embodiment of the present invention.

Here, note that the first sheet P1 thus separated passes the optical sensor 97 through the conveying path 106, as shown in FIG. 7. At this time, the second sheet P2 is conveyed on the fixing belt 56, in the course of which the toner image formed on the surface of the second sheet P2 is embedded into the resin layer. With the toner image being embedded into the resin layer, luster is given to the image of the recording paper. Also, the third sheet P3 is temporarily stopped by being detected by the registration sensor 62. The fourth sheet P4 is stopped, upon detection thereof by the sensor 92, at a location at which it is clamped by the conveyance rollers 72, and the fifth sheet P5 passes through the fixing unit 40 of the image forming apparatus main body A.

Figure 8:
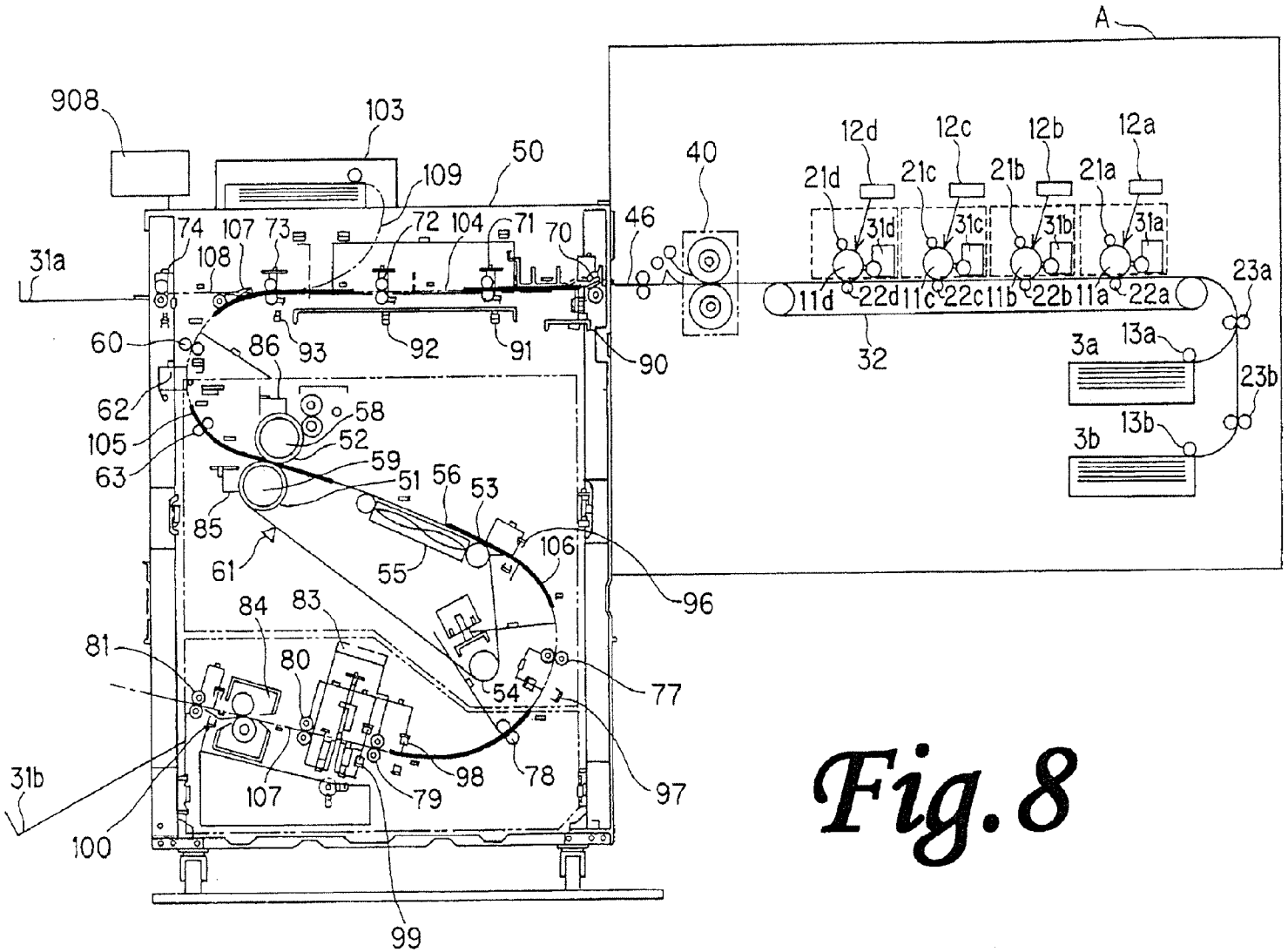
FIG. 8 is a view showing the conveyance sequence of the recording material at the normal time in the image forming apparatus according to the first embodiment of the present invention.

Thereafter, as shown in FIG. 8, the first sheet P1 is conveyed up to the sensor 98 arranged immediately before the cutter 83, where it is temporarily stopped by being clamped by the conveyance rollers 79. At this time, the second sheet P2 passes through he conveying path 106 while being peeled or separated from the fixing belt 56. Also, the third sheet P3 is conveyed on the fixing belt 56 at predetermined timing, in the course of which a toner image is embedded into a resin layer thereof, as in the first sheet P1 and the second sheet P2 preceding thereto. The fourth sheet P4 passes through the flapper 107, and the fifth sheet P5 passes through the conveying path 104.

Subsequently, the first sheet P1 is conveyed to the cutter registration sensor 99 in the form of an optical sensor, and is cut out by the cutters 83, 84 based on a predetermined sequence. Here, the first sheet P1 is cut out at its upper (leading) and lower (trailing) ends and at its right and left (lateral) sides with a cutting length WT and a cutting width WY, respectively, that are shorter than the lengths and widths of margin areas of the first sheet P1, and is then carried out to the discharge tray 31*b*. The following second through fifth sheets P2 through P5 are similarly subjected to cutting processing, as in the first sheet P1, and is then carried out to the discharge tray 31*b*.

(Outline of the Operation at Abnormal Time)

Next, reference will be made to the outline of a series of continuous operations of the image forming apparatus according to this first embodiment at an abnormal time. Here, an exemplary case will be described in which an image is continuously output in five sheets of paper in a photograph mode.

Figure 9:
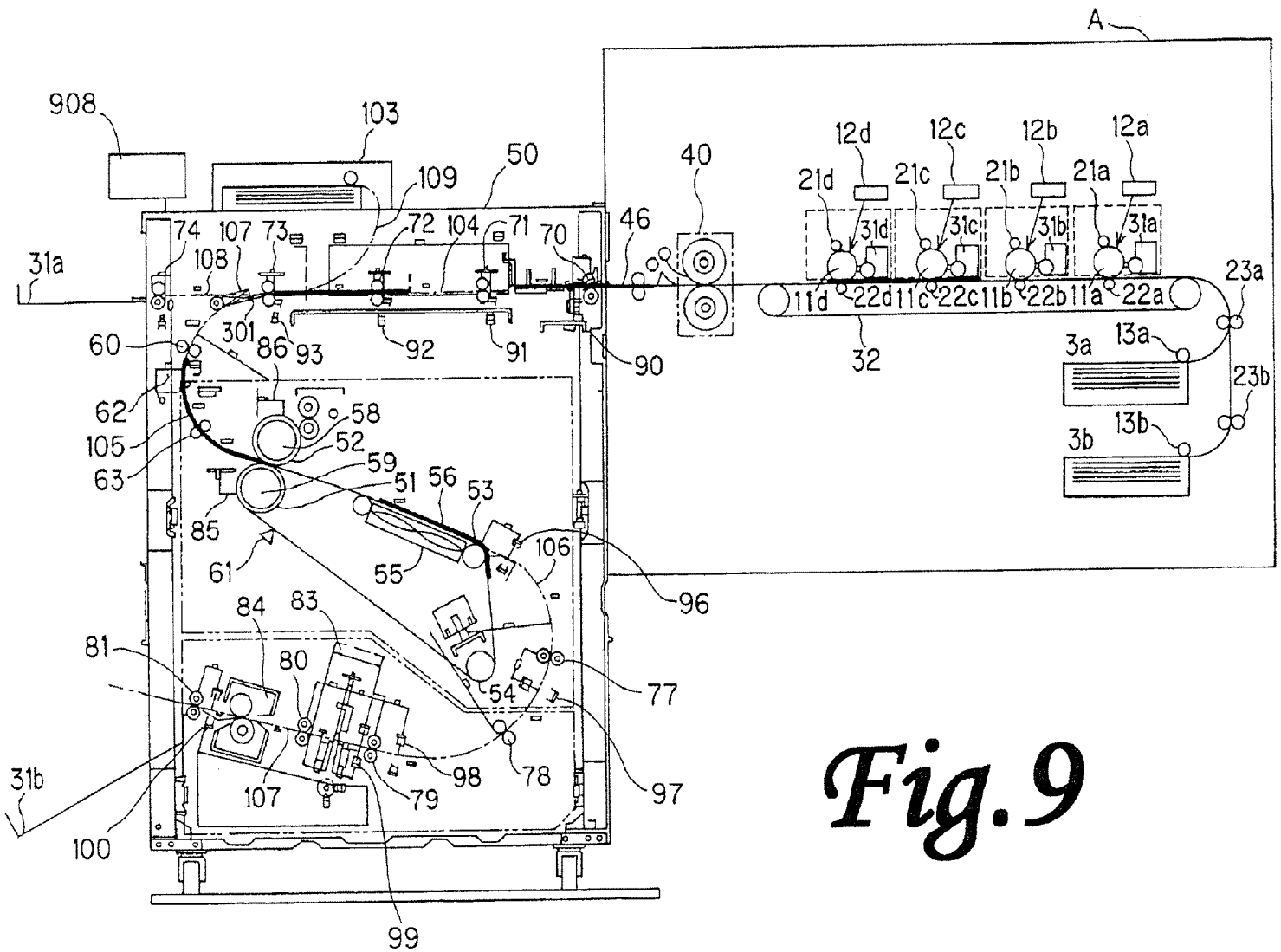
FIG. 9 is a view showing the conveyance sequence of the recording material at an abnormal time in the image forming apparatus according to the first embodiment of the present invention.

As shown in FIG. 9, a first sheet P1 on which an image is formed by the image forming apparatus main body A is conveyed on the fixing belt 56 through the conveying paths 104, 105 according to a predetermined sheet conveyance sequence.

Thereafter, when the first sheet P1 is not peeled or separated from the fixing belt 56 and such a state of the non-separation of the first sheet P1 is detected by the separation sensor 96 in the form of an optical sensor, the conveyance of the first sheet P1 and a second sheet P2 in the fixing unit 50 are stopped, and a temperature adjusting operation is stopped in response to the stopping of the conveyance of the first sheet P1 and the second sheet P2. In addition, at this time, the flapper 107 is switched over. In other words, the flapper 107 is controlled by the CPU 401 so as to be swung to a position to guide a recording paper to the discharging conveying path 108. Accordingly, the third sheet P3 existing on the conveying path 104 at a location upstream of the branch portion 301 is guided to the discharging conveying path 108.

In other words, when the CPU 401 determines based on the output of the separation sensor 96 that abnormality occurred in the second heating device, the CPU 401 controls the driving of the fixing belt 56 and the pressure roller 52 so as to stop the conveyance of the recording paper downstream of the branch portion. Further, when the CPU 401 determines based on the output of the separation sensor 96 that abnormality occurred in the second heating device, the CPU 401 controls the flapper 107 to swing downwardly so as to discharge the recording paper upstream of the branch portion 301 to the outside of the apparatus through the discharging conveying path 108, and at the same time controls the conveyance rollers 70, 71, 72, 73, 74 to discharge the recording paper upstream of the branch portion 301 through the discharging conveying path 108.

Figure 10:
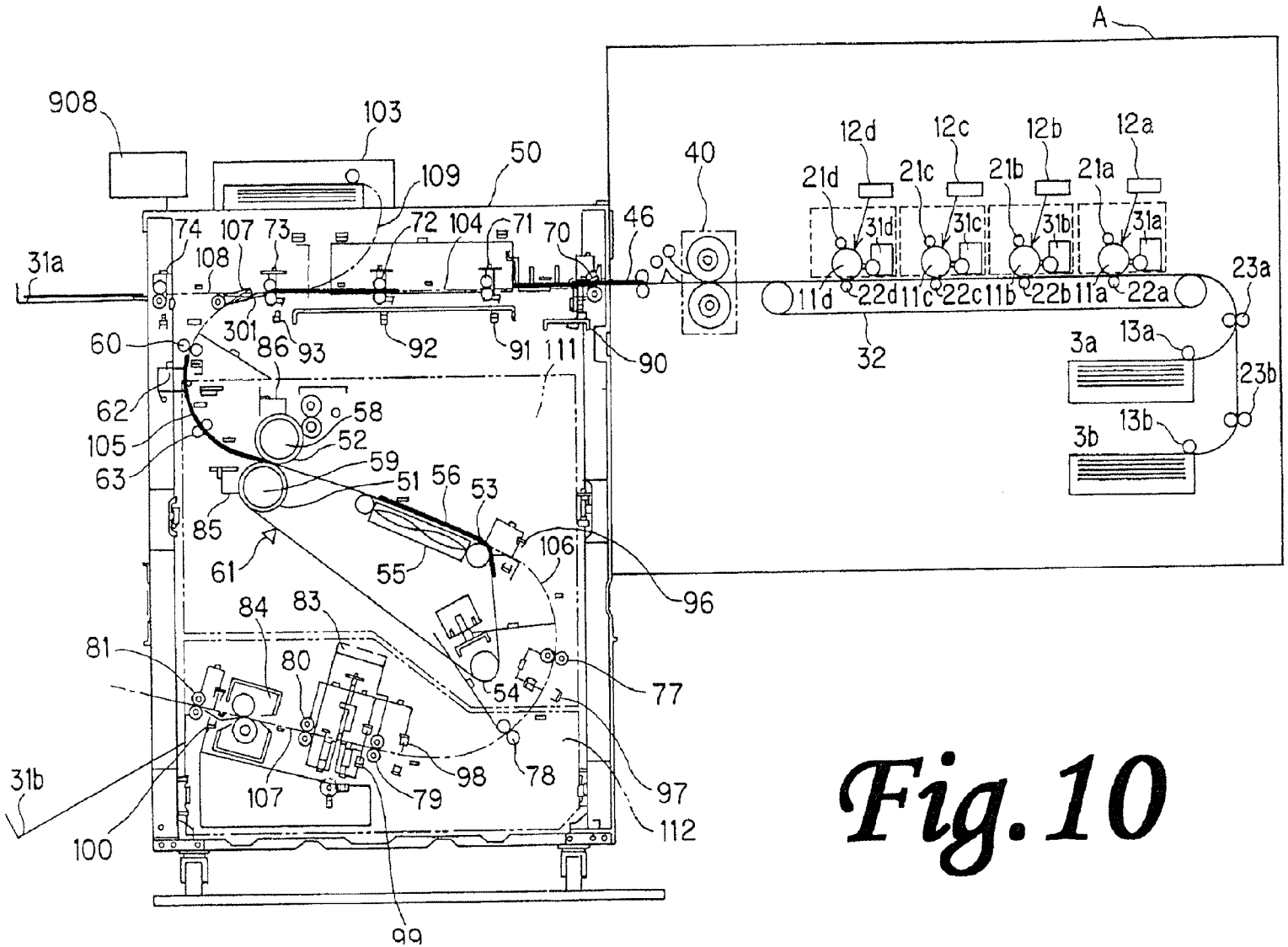
FIG. 10 is a view showing the conveyance sequence of the recording material at the abnormal time in the image forming apparatus according to the first embodiment of the present invention.
Figure 11:
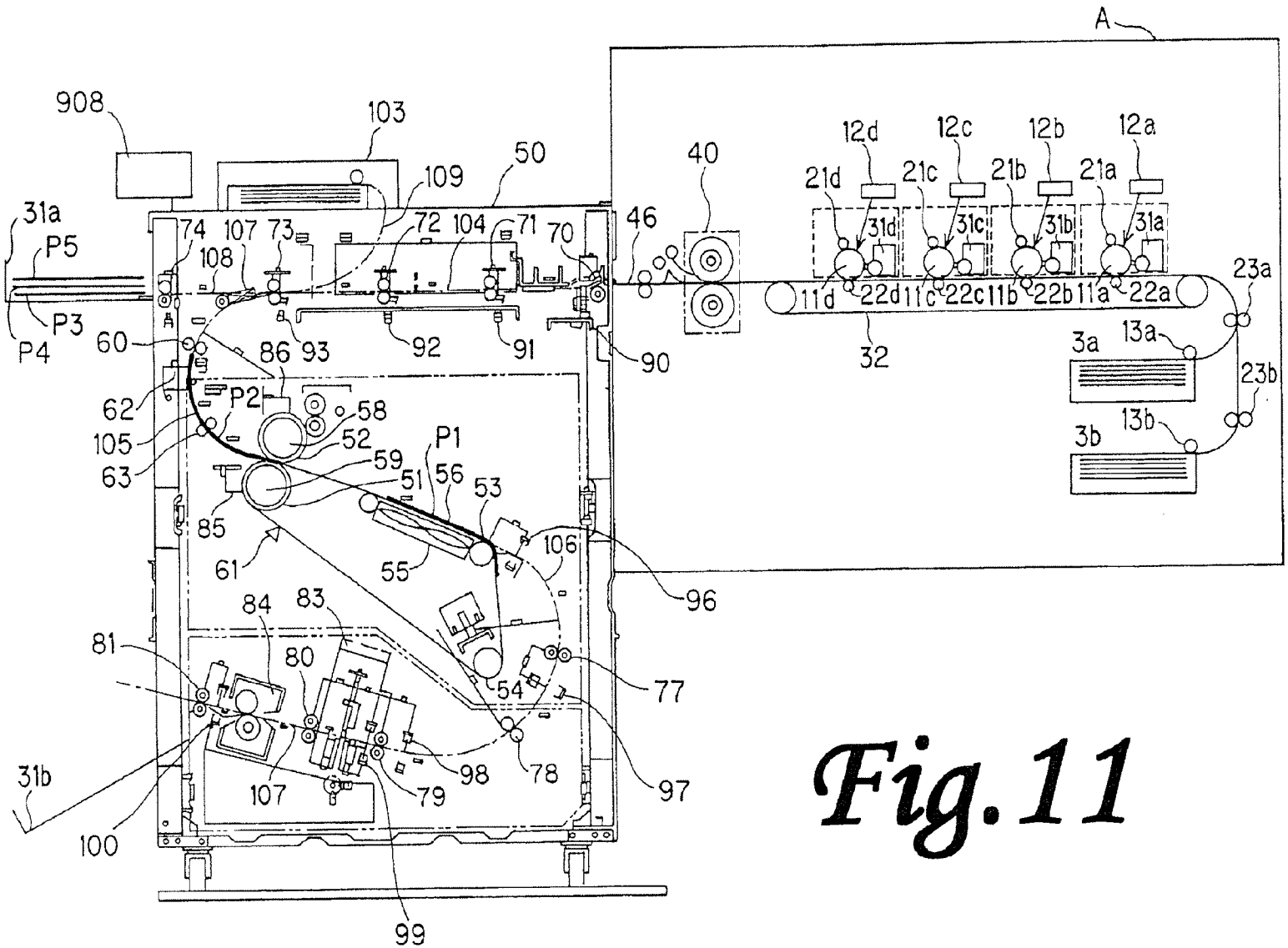
FIG. 11 is a view showing the conveyance sequence of the recording material at the abnormal time in the image forming apparatus according to the first embodiment of the present invention.

According to the above operations, the third sheet P3 is discharged to the discharge tray 31*a*, as shown in FIG. 10. In addition, processing similar to the processing performed on the third sheet P3 is carried out on the following fourth and fifth sheets P4, P5 that exist upstream of the third sheet P3. In other words, the following fourth and fifth sheets P4, P5 are also discharged to the outside of the apparatus through the discharging conveying path 108. As a result, the third sheet P3 through the fifth sheet P5 are discharged onto the discharge tray 31*a*, as shown in FIG. 11.

(Outline of Recovery Operation)

Next, reference will be made to the outline of a series of recovery operations according to this image forming apparatus. First of all, the third sheet P3, the fourth sheet P4, and the fifth sheet P5 are discharged to the discharge tray 31*a* in accordance with the occurrence of an abnormality of the image forming process in the image forming apparatus according to this first embodiment. The user is prompted by the display device 908 to set the third sheet P3, the fourth sheet P4 and the fifth sheet P5 discharged to the discharge tray 31*a* onto the paper refeeding tray 103*a*, whereby these sheets P3 through P5 are sequentially loaded or stacked one over another on the paper refeeding tray 103*a* of the paper refeeding unit 103 by the user with their toner image forming surfaces being directed downwardly.

In addition, when an information signal indicating that the setting of the third sheet P3, the fourth sheet P4 and the fifth sheet P5 in the paper refeeding unit 103 has been completed is supplied to the control portion of the image forming apparatus (see FIG. 3), a series of recovery operations are executed. In the recovery operations, the image forming operation is executed in succession based on a predetermined sequence.

Figure 12:
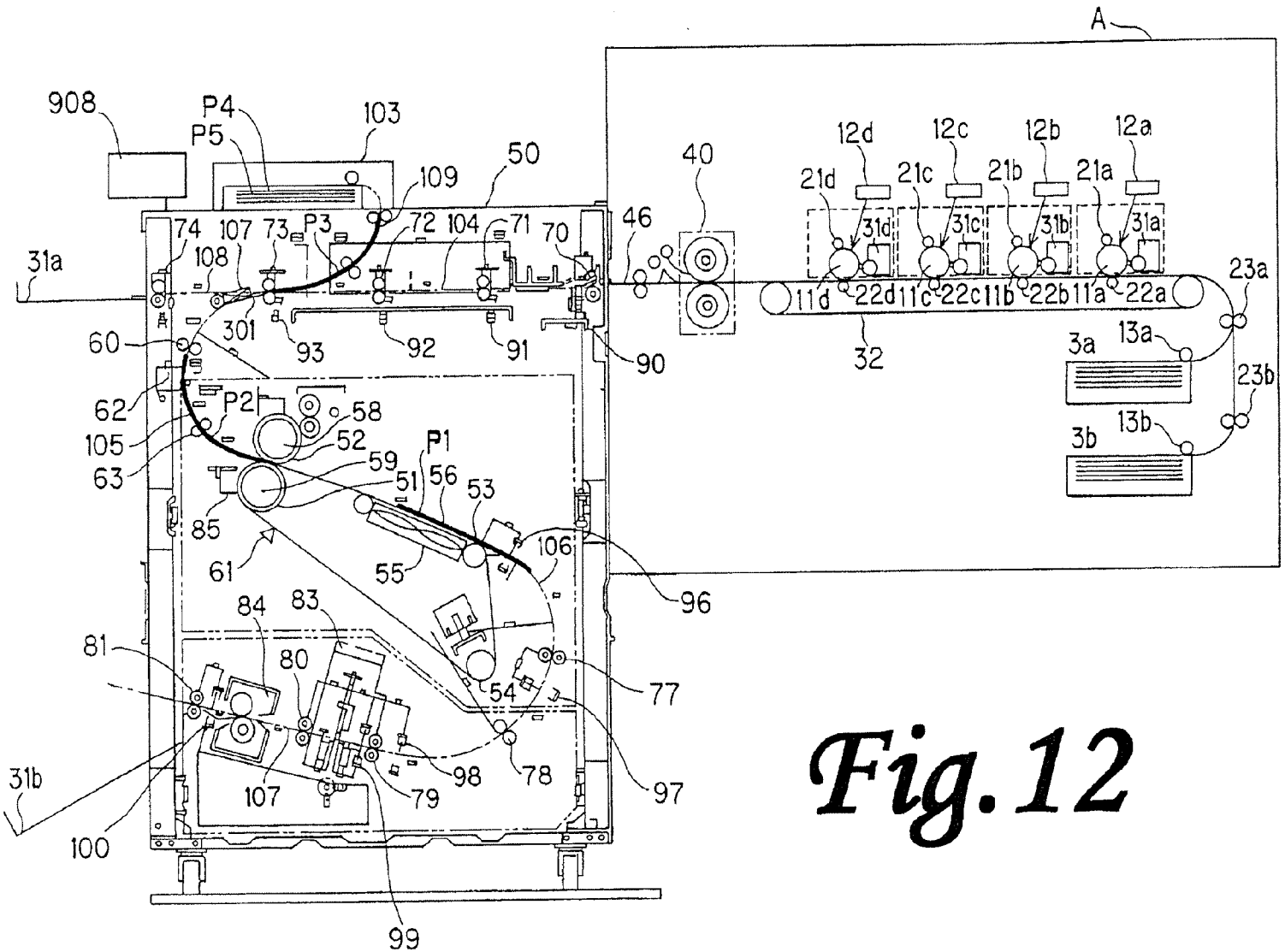
FIG. 12 is a view showing the conveyance sequence of the recording material at the time of recovery in the image forming apparatus according to the first embodiment of the present invention.

First of all, the image forming apparatus main body A freshly performs image formation by using new pieces of recording paper P as a first sheet P1 and a second sheet P2. The first sheet P1 and the second sheet P2 with images formed thereon are conveyed to the fixing unit 50, as shown in FIG. 12, and similar processes as those at the time of normal operation are executed thereon. In another words, the images on the sheets are heated by the fixing belt while passing the conveying paths 104, 105, 106, respectively, of the fixing unit 50. Here, the conveyance of the third sheet P3 is performed through the feeding conveying path 109 at the timing at which the second sheet P2 is conveyed to the fixing belt 56, and similarly in the fourth sheet P4 and the firth sheet P5, the supply of the sheets to the conveying path 105 is sequentially executed through the feeding conveying path 109. When all the sheets are finally discharged to the discharge tray 31*b*, the recovery operations are terminated.

(Continuous Operation Process at Abnormal Time)

Figure 13:
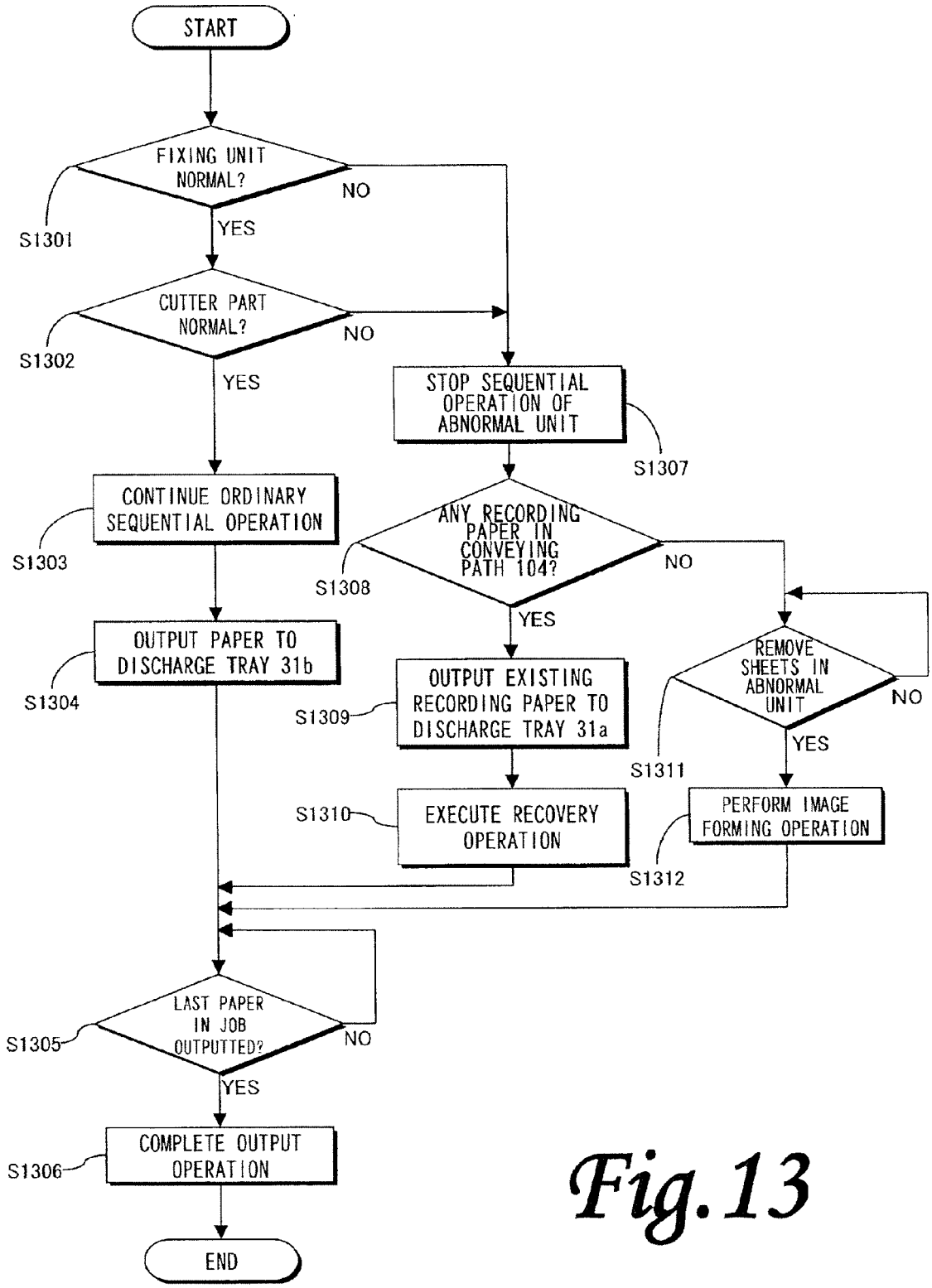
FIG. 13 is a flow chart showing a series of continuous operations of the image forming apparatus according to the first embodiment of the present invention at the abnormal time.

Next, reference will be made to a series of continuous operations of the image forming apparatus according to this first embodiment at an abnormal time thereof. In FIG. 13, there is shown a flow chart of this image forming apparatus.

As shown in FIG. 13, in this first embodiment, first in step S1301, the CPU 401 determines, based on the output of the separation sensor 96 or the like, whether a second heating device in the form of a fixing unit 111 (see FIG. 10) is normal. When the fixing unit 111 is normal (S1301: YES), the control flow shifts to step S1302.

In step S1302, the CPU 401 determines, based on the outputs of the optical sensors 98, 99, 100 or the like, whether a cutting device in the form of a cutter portion 112 is normal. When it is determined in step S1302 that the cutter portion 112 is normal, the control flow shifts to step S1303 where an ordinary sequential operation is executed by the CPU 401. Then, the control flow shifts to step S1304 where the pieces of recording paper P to be output are discharged to the discharge tray 31*b* according to an output order.

Thereafter, the control flow shifts to step S1305 where the CPU 401 determines whether the last piece of recording paper P in that job has been output. In this first embodiment, a determination as to whether the fifth piece of output paper has been output is made by the CPU 401. When the last piece of recording paper P (here, the fifth sheet P5) has been output, the control flow goes to step S1306 where the output operation is completed.

On the other hand, when the CPU 401 determines in step S1301 that the fixing unit 111 is abnormal (S1301: NO), or when the CPU 401 determines in step S1302 that the cutter portion 112 is abnormal (S1302: NO), the control flow shifts to step S1307 where the CPU 401 controls to stop the operation sequence of the abnormal unit or portion. Specifically, in step S1307, the CPU 401 controls to stop the operations of the fixing belt 56 and the conveyance rollers 77, 78, 79, 80, 82.

Then, the control flow shifts to step S1308 where the CPU 401 determines whether the recording paper P exists on the conveying path 104.

When the CPU 401 determines that there exists no recording paper P on the conveying path 104 (S1308: NO), the control flow shifts to step S1311 where the CPU 401 determines whether the recording paper P has been removed from a part where the conveyance abnormality of the recording paper P has occurred. The image forming process by the image forming apparatus is made to wait until the recording paper of which the conveyance was stopped upon occurrence of the abnormality is removed. At the time when the recording paper P in the abnormal unit has been removed, the control flow shifts again to step S1311 where an ordinary image forming operation is executed in step S1311. That is, the sheet, having been subjected to the jam processing in the image formation, is removed, and an image forming process is carried out on a new recording paper in the image forming apparatus main body A. After that, the control flow shifts to step S1305.

When the CPU 401 determines in step S1308 that there exists recording paper P on the conveying path 104 (S1308: YES), the control flow shifts to step S1309. In step S1309, the CPU 401 controls the driving of the conveyance rollers 70, 71, 72, 73, 74 and the operation of the flapper 107 so as to discharge the recording paper P existing on the conveying path 104 to the discharge tray 31*a*. Here, the third sheet P3, the fourth sheet P4 and the fifth sheet P5 are sequentially discharged to the discharge tray 31*a*. Thereafter, the control flow shifts to step S1310 where the CPU 401 executes a recovery operation.

In addition, after the termination of the recovery operation in step S1310, the control flow shifts to step S1306 where the output operation is completed, as stated above, at the time when it is verified that the last piece of recording paper P (here, the fifth sheet P5) in the job in step S1305 has been output. Here, note that after the completion of the output operation, the image forming apparatus main body A is restored to a standby state.

(Recovery Operation)

Next, detailed reference will be made to the recovery operation of the image forming process according to this first embodiment by using a flow chart in FIG. 14.

Figure 14:
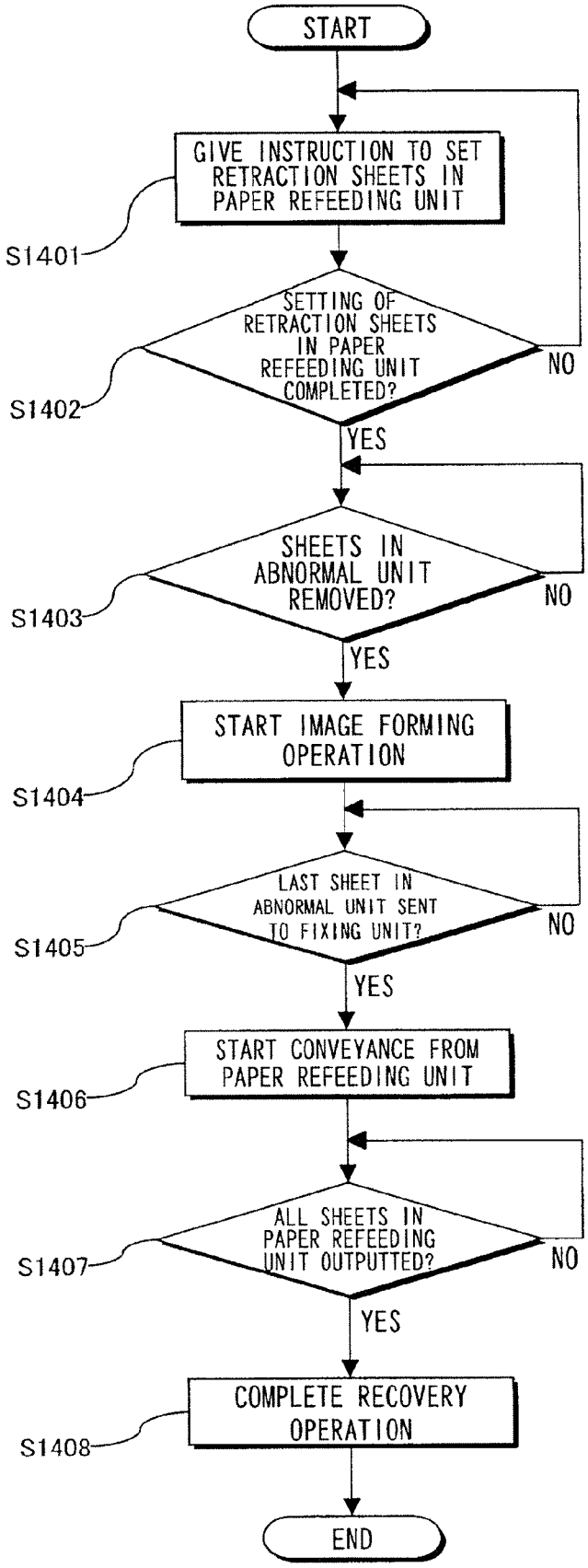
FIG. 14 is a flow chart showing a series of recovery operations of the image forming apparatus according to the first embodiment of the present invention at the abnormal time.

As shown in FIG. 14, first in step S1401, the CPU 401 controls the display of an annunciation portion in the form of a display device 908 in such a manner as to inform the user to set pieces of recording paper P (here, the third sheet P3 through the fifth sheet P5, and hereinafter referred to as retraction sheets) discharged to the discharge tray 31*a* into the paper refeeding unit 103. Here, the CPU 401 controls the display device 908 in such a manner that the display device 908 displays an indication "Please set the sheets discharged to a tray at a side of the apparatus onto a tray on an upper surface of the apparatus". Although the annunciation portion in the form of a displayed indication of the display device 908 for information to the user has been exemplified herein, there may be adopted, as such an annunciation portion, other methods such as displaying such an indication on an operation panel (not shown) in the image forming apparatus, etc. In addition, as an information method for the annunciation portion, there may be adopted any methods such as outputting a voice, blinking a diode, etc., as long as the user can recognize the intended information by such methods. In this case, the CPU 401 is constructed so as to control the output of the voice or blinking of the diode in the annunciation portion.

Then, the control flow shifts to step S1402 where the CPU 401 determines whether all the retraction sheets have been set in the paper refeeding unit 103. Here, it is determined whether the third sheet P3 through the fifth sheet P5 have been loaded and received in the paper refeeding unit 103. Such a determination as to whether the retraction sheets have been set in the sheet feeding unit 103 is made by the CPU 401 based on the output of the presence or absence detecting sensor 103*b* that detects the presence or absence of a sheet on the paper refeeding tray 103*a*. At the time when all these retraction sheets have been set, the control flow shifts to step S1403. Although there has been exemplified a form in which a determination as to whether the retraction sheets have been set in the sheet feeding unit 103 is made by the CPU 401 based on the output of the presence or absence detecting sensor 103*b*, it may instead be constructed such that the user is prompted to input the purport of the completion of setting, and the CPU 401 determines, based on the user's input, the completion of setting of the retraction sheets in the sheet feeding unit 103.

In step S1403, the CPU 401 determines whether the recording paper P has been removed from a part where the conveyance abnormality of the recording paper P has occurred. Here, the CPU 401 determines whether the jam clearance operation of the first sheet P1 and the second sheet P2 has been performed. The image forming process by the image forming apparatus is made to wait until the first sheet P1 and the second sheet P2 of which the conveyance was stopped upon occurrence of the abnormality is removed. At the time when these pieces of recording paper P in the abnormal unit have been removed, the control flow shifts again to step S1311 where an ordinary image forming operation is executed in step S1404. Specifically, the first sheet P1 and the second sheet P2 on which the jam clearance process in the image formation has been carried out are discarded, and the image forming process to a first sheet P1 and a new second sheet P2 is performed in the image forming apparatus main body A. An image is freshly formed on the first sheet P1 and the second sheet P2. Thereafter, in step S1405, the CPU 401 makes a determination as to whether the last sheet of the abnormal unit, i.e., the second sheet P2 in this case, has been conveyed to the above-mentioned fixing unit.

When the CPU 401 determines that the last one of the sheets on which the image is newly formed have been conveyed to the fixing unit 50, the control flow shifts to step S1406. In step S1406, the CPU 401 controls the paper refeeding unit 103 so as to feed the retraction sheets (the third through fifth sheets P3, P4, P5) thus set in a sequential manner. The order of feeding here is as follows: the third sheet P3, the fourth sheet P4 and the fifth sheet P5. In step S1407, the CPU 401 determines whether all of the retraction sheets set in the paper refeeding unit 103 have been output, and when all the sheets have been discharged, the control flow shifts to step S1408 where the recovery operation is terminated.

As described in the foregoing, according to this first embodiment, there can be obtained a fixing unit and an image forming apparatus provided with such a fixing unit which, upon occurrence of an abnormality, can perform restoration operation without excluding or discarding recording paper wastefully.

Although in the foregoing description, one or the first embodiment of the present invention has been specifically described, the present invention is not limited to the above-mentioned embodiment, and the invention can be varied into a variety of forms based on the technical thought of the present invention. For example, materials and the like enumerated in the above-mentioned one or first embodiment are merely some examples, so materials different from these may be used as required.

(Outline of the Operation at Abnormal Time in a Second Embodiment)

Next, reference will be made to the outline of a series of continuous operations of an image forming apparatus according to a second embodiment at an abnormal time. Here, an exemplary case will be described in which an image is continuously output in three sheets of paper in a photograph mode.

Figure 15:
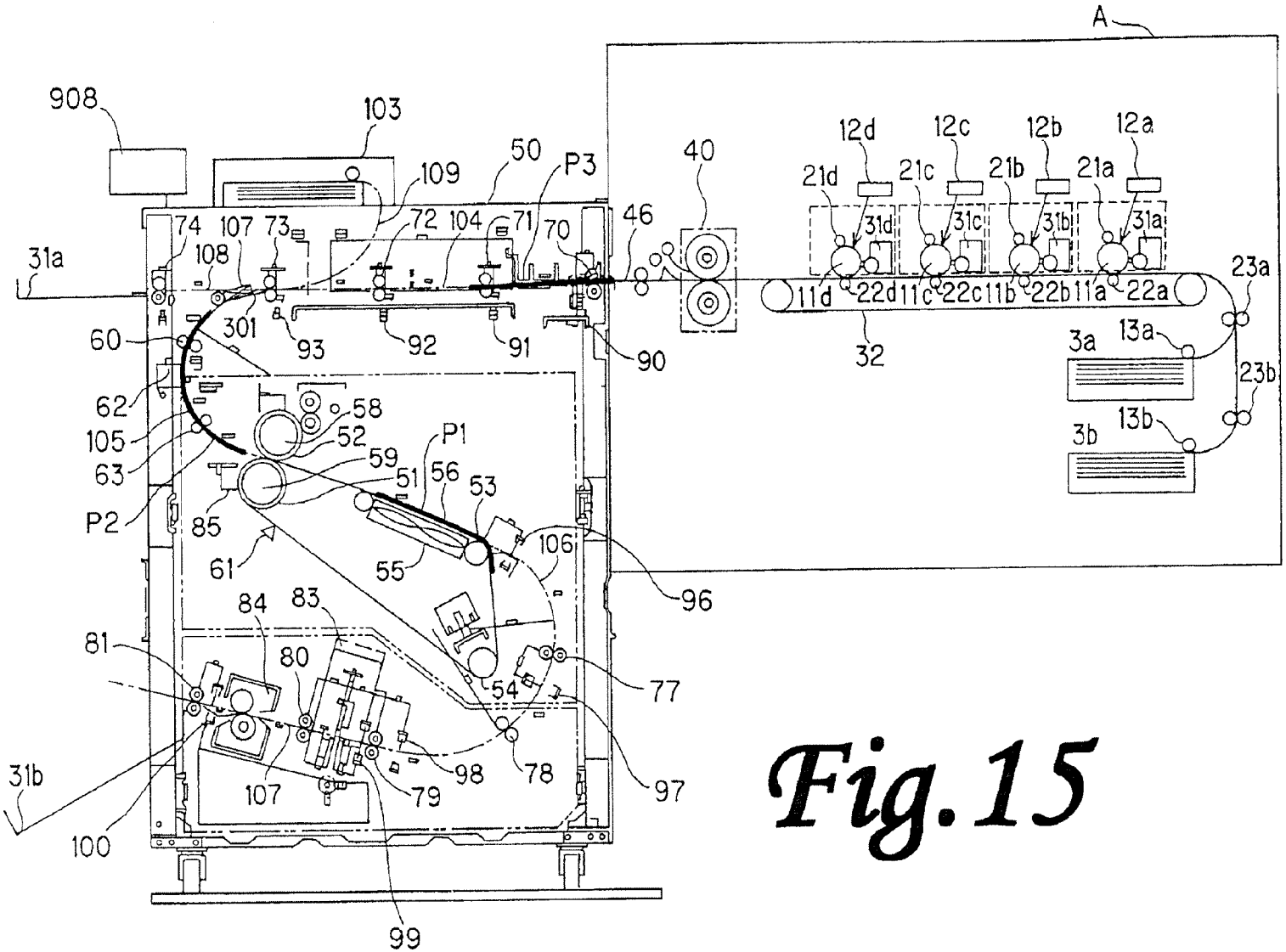
FIG. 15 is a view showing the conveyance sequence of a recording material at a normal time in an image forming apparatus according to a second embodiment of the present invention.

As shown in FIG. 15, a first sheet P1 on which an image is formed by an image forming apparatus main body A is conveyed on a fixing belt 56 through conveying paths 104, 105 according to a predetermined sheet conveyance sequence.

Thereafter, in case of the occurrence of an abnormality in which the first sheet P1 is not peeled or separated from the fixing belt 56, such a state of non-separation of the first sheet P1 is detected by a separation sensor 96 in the form of an optical sensor. At this time, a second sheet P2 is conveyed in the conveying path 105, and a leading end of the second sheet P2 has not yet arrived at the fixing belt 56. The third sheet P3 is conveyed over a conveying path 46 and the conveying path 104 of the image forming apparatus main body A.

Here, when the CPU 401 determines based on the output of the separation sensor 96 that the first sheet P1 is not peeled from the fixing belt 56, the CPU 401 controls to stop the conveyance roller and the fixing belt so that the conveyance of the first sheet P1 1, the second sheet P2 and the third sheet P3 in the fixing unit 50 are stopped, and a temperature adjusting operation is stopped in response to the stopping of the conveyance of the respective sheets.

Figure 16:
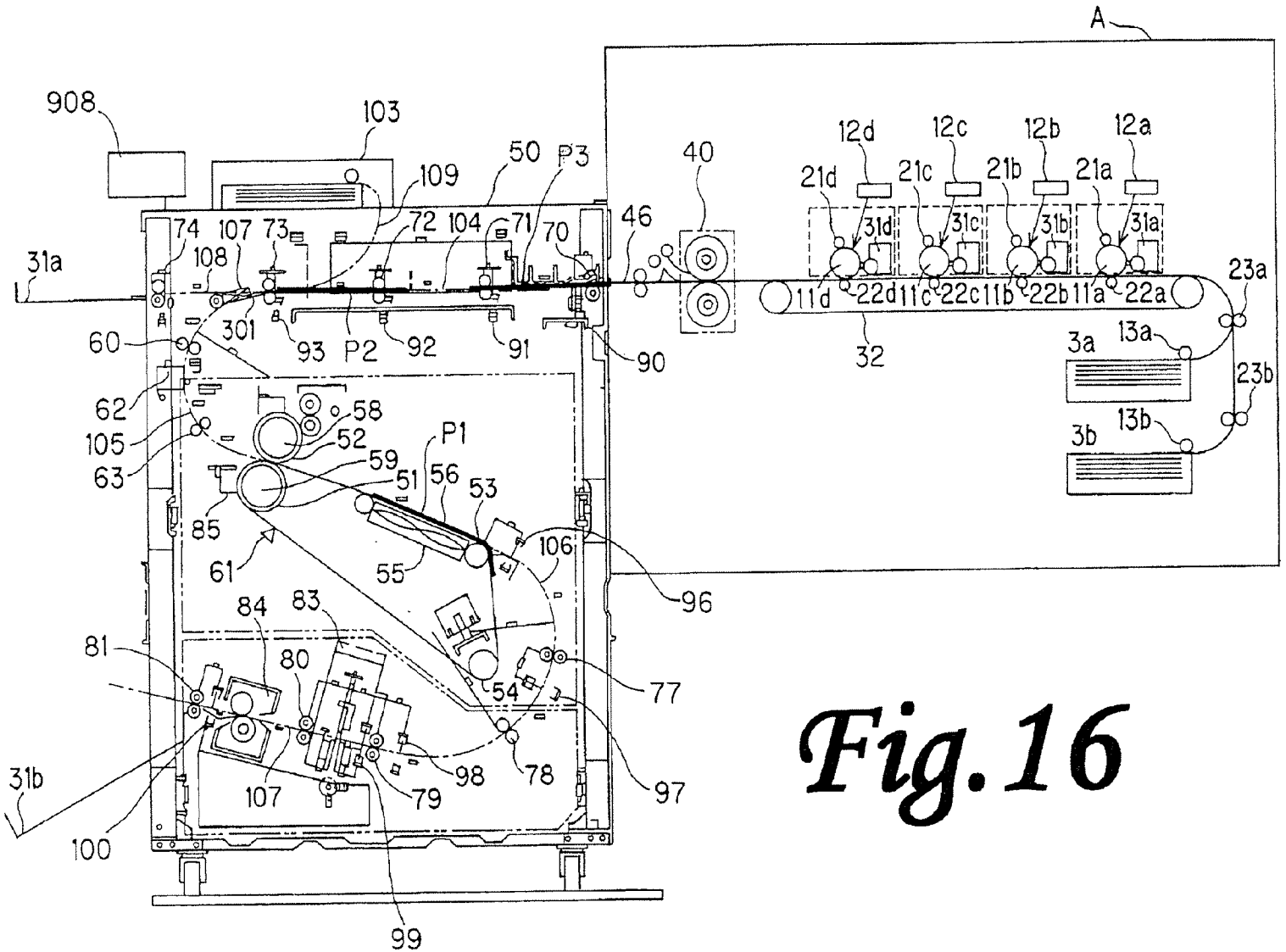
FIG. 16 is a view showing the conveyance sequence of the recording material at the normal time in the image forming apparatus according to the second embodiment of the present invention.

Thereafter, the CPU 401 controls the rotation of conveyance rollers 60, 63, 73, 72 in such a manner that the second sheet, of which the leading end lies downstream of a branch portion 301 and does not reach the fixing belt 56, is conveyed in a direction opposite to the ordinary conveying direction. The conveyance of the second sheet P2 in the direction opposite to the ordinary conveying direction is carried out until the leading end of the second sheet P2 reaches a location upstream of the branch portion 301 (see FIG. 16). After that, a flapper 107 is controlled by the CPU 401 so as to be swung to a position to guide a recording paper to a discharging conveying path 108, and the second sheet P2, which has been conveyed until the leading end thereof reaches a location upstream of the branch portion 301, and the third sheet P3 are conveyed in the ordinary conveying direction. As the flapper 107 is located at a position to guide the recording paper to the discharging conveying path 108, the second sheet P2 and the third sheet P3 are guided to the discharging conveying path 108 side to be discharged onto the discharge tray 31*a*.

In other words, when it is determined based on the output of the separation sensor 96 that abnormality occurred in a second heating device, the CPU 401 controls in such a manner that the recording paper, which lies at the downstream side of the branch portion 301 and has not reached the second heating device, is conveyed to a location upstream of the branch portion 301. Thereafter, in order to discharge the recording paper (the second sheet P2), which has been conveyed to the upstream side of the branch portion 301 through the discharging conveying path 108, and the recording paper (the third sheet P3) originally existing at the upstream side of the branch portion 301 to the outside of the apparatus, the CPU 401 controls the flapper 107 to swing downwardly, and at the same time controls conveyance rollers 70, 71, 72, 73, 74 to discharge these pieces of recording paper upstream of the branch portion 301 through the discharging conveying path 108.

(Continuous Operation Process at Abnormal Time)

Figure 17:
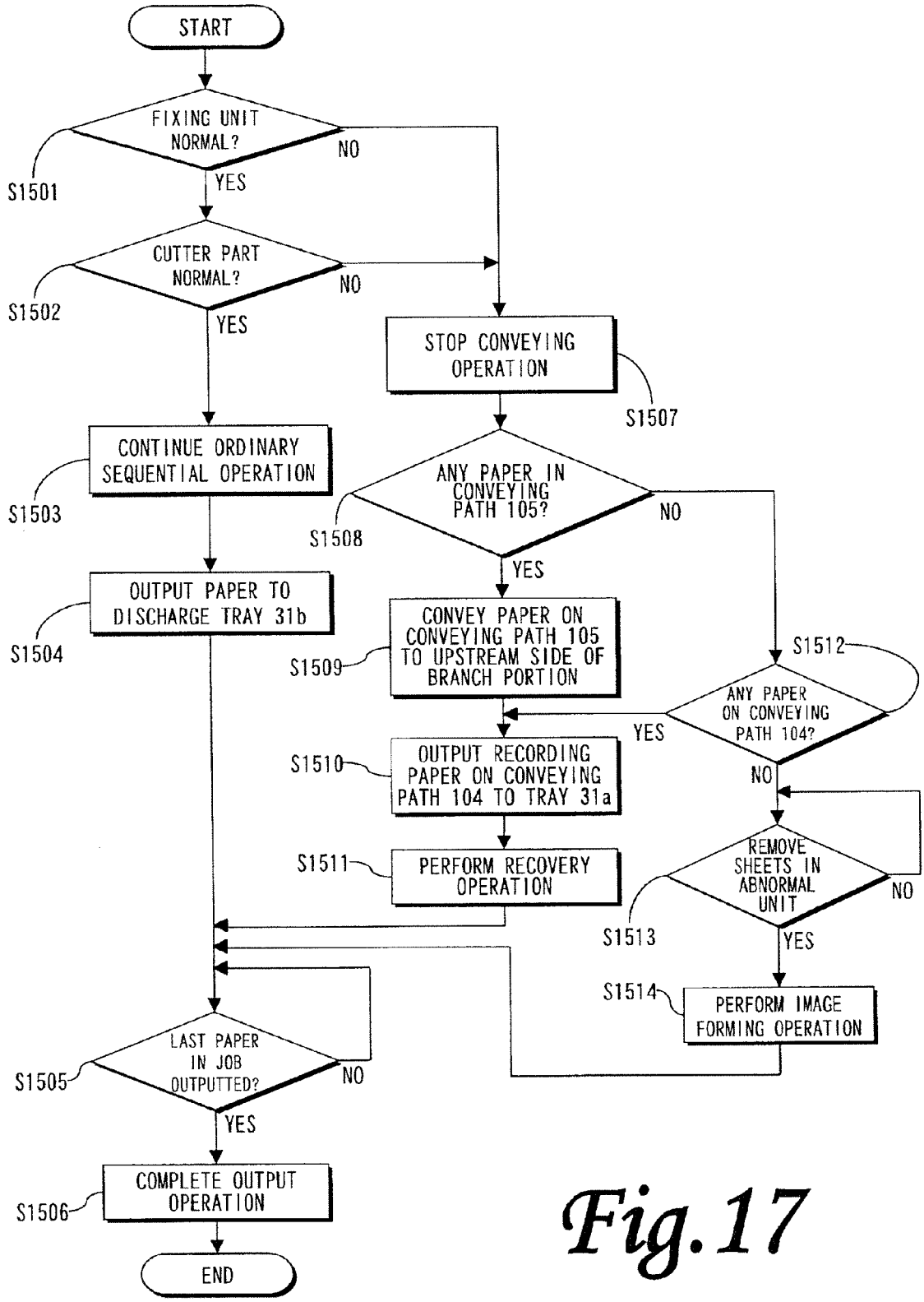
FIG. 17 is a flow chart showing a series of continuous operations of the image forming apparatus according to the second embodiment of the present invention at an abnormal time.

Next, reference will be made to a series of continuous operations of the image forming apparatus according to this second embodiment at an abnormal time thereof. In FIG. 17, there is shown a flow chart of this image forming apparatus.

As shown in FIG. 17, in this second embodiment, first in step S1501, the CPU 401 determines, based on the output of the separation sensor 96 or the like, whether the second heating device in the form of a fixing unit 111 (see FIG. 10) is normal, and when the fixing unit 111 is normal (S1501: YES), the control flow shifts to step S1502.

In step S1502, the CPU 401 determines, based on the outputs of optical sensors 98, 99, 100 or the like, whether a cutting device in the form of a cutter portion 112 is normal. When it is determined in step S1502 that the cutter portion 112 is normal, the control flow shifts to step S1503 where an ordinary sequential operation is executed by the CPU 401. Then, the control flow shifts to step S1504 where the pieces of recording paper P to be output are discharged to a discharge tray 31*b* according to an output order.

Thereafter, the control flow shifts to step S1505 where the CPU 401 determines whether the last piece of recording paper P in that job has been output. In this second embodiment, a determination as to whether the third piece of output paper has been output is made by the CPU 401, and when the last piece of recording paper P (here, the third sheet P3) has been output, the control flow goes to step S1506 where the output operation is completed.

On the other hand, when the CPU 401 determines in step S1501 that the fixing unit 111 is abnormal (S1501: NO), or when the CPU 401 determines in step S1502 that the cutter portion 112 is abnormal (S1502: NO), the control flow shifts to step S1507. In step S157, the CPU 401 controls to stop the conveying operation of the recording paper. Specifically, in step S1507, the CPU 401 controls to stop the operations of the fixing belt 56 and the conveyance rollers 77, 78, 79, 80, 82.

Then, the control flow shifts to step S1508 where the CPU 401 determines whether recording paper P exists on the conveying path 105. Here, note that whether recording paper P exists in the conveying path 105 means whether there exists a sheet having its leading end located downstream of the branch portion 301 and upstream of the fixing belt 56. Here, note that a determination as to whether recording paper P exists in the conveying path 105 is made by the CPU 401 based on the detection of a leading end of a sheet by means of a registration sensor 62, the distance of the sheet that is conveyed by a conveyance roller 60 from the time point of detection of the leading end thereof by the registration sensor 62 to the time point of occurrence of an abnormality.

When the CPU 401 determines in step S1508 that there exists recording paper P on the conveying path 105 (S1508: YES), the control flow shifts to step S1509. In step S1509, the CPU 401 controls the rotation of the conveyance rollers 60, 73 so as to convey the recording paper P existing on the conveying path 105 in a direction opposite to an ordinary conveying direction (in a direction toward the conveying path 104). The CPU 401 terminates the conveyance of the recording paper based on the fact that an end of the recording paper, being conveyed in the direction opposite to the ordinary direction so as to be conveyed up to a location where the end of the recording paper reaches upstream of the branch portion 301 (a side of the conveying path 104), has been detected by an optical sensor 93 located at an upstream side of the branch portion 301. After that, in step S1510, the CPU 401 controls the driving of the conveyance rollers 70, 71, 72, 73, 74 and the operation of the flapper 107 so as to discharge the recording paper existing on the conveying path 104 upstream of the branch portion 301 to the discharge tray 31*a*. Here, the second sheet P2 and the third sheet P3 returned to the conveying path 104 are sequentially discharged to the discharge tray 31*a*. Thereafter, the control flow shifts to step S1511 where the CPU 401 executes a recovery operation. The recovery operation is similar to that in the first embodiment shown in FIG. 14, and hence a description thereof is omitted.

In addition, after the termination of the recovery operation step S1511, the control flow shifts to step S1506 where the output operation is completed, as stated above, at the time when it is verified that the last piece of recording paper P (here, the third sheet P3) in the job in step S1505 has been output. Here, note that after the completion of the output operation, the image forming apparatus main body A is restored to a standby state.

When the CPU 401 determines in step S1508 that there exists no recording paper P on the conveying path 104 (S1508: NO), the control flow shifts to step S1512. In step S1512, it is determined by the CPU 401 whether recording paper exists in the conveying path 104. When the CPU 401 determines that there is recording paper in the conveying path 104, the control flow shifts to step S1510 where the CPU 401 performs the above-mentioned processes.

On the other hand, when the CPU 401 determines that there is no recording paper in the conveying path 104, the control flow shifts to step S1513. In step S1513, the CPU 401 determines whether the recording paper P has been removed from a part where the conveyance abnormality of the recording paper P has occurred. That is, the image forming process by the image forming apparatus is made to wait until the recording paper of which the conveyance was stopped upon occurrence of the abnormality is removed. At the time when these pieces of recording paper P in the abnormal unit have been removed, the control flow shifts to step S1514 where an ordinary image forming operation is executed. That is, the sheet, having been subjected to the jam processing in the image formation, is removed, and an image forming process is carried out on a new recording paper in the image forming apparatus main body A. After that, the control flow shifts to step S1505.

While the invention has been described in terms of preferred embodiments, those skilled in the art will recognize that the invention can be practiced with modifications within the spirit and scope of the appended claims.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-265571, filed Sep. 13, 2005 which is hereby incorporated by reference herein in its entirety.

What is claimed is:

1. An image forming apparatus comprising:

a first heating device which heats a sheet with a toner image formed thereon;

a second heating device which heats said sheet heated by said first heating device;

a first conveying path which conveys said sheet conveyed from said first heating device to said second heating device;

a second conveying path which branches from said first conveying path at a location upstream of said second heating device in said first conveying path for conveyance of said sheet without conveying it to said second heating device;

a discharge tray to which said sheet being conveyed on said second conveying path is discharged;

a feeding portion which feeds sheets put on a paper refeeding tray; and a feeding conveying path which conveys a sheet fed by said feeding portion to said second heating device, said feeding conveying path having a downstream portion merged into said first conveying path at a location between said first heating device and said second heating device;

an abnormality control portion which issues an abnormality factor that occurs in said second heating device, and a sheet located upstream of said branch portion in said first conveying path is discharged to said discharge tray through said second conveying path; and an annunciation portion is provided which serves to inform that said sheet discharged to said discharge tray should be set in said refeeding tray when said sheet has been discharged to said discharge tray upon occurrence of the abnormality factor in said second heating device.

2. The image forming apparatus according to claim 1, wherein after said abnormality factor in said second heating device is removed and said sheet discharged to said discharge tray through said second conveying path is put on said paper refeeding tray, said sheet put on said paper refeeding tray is fed by said feeding conveying path.

3. The image forming apparatus according to claim 1, wherein said second heating device includes a heating portion and a cooling portion, and provides a luster to the image on said sheet by heating said sheet, which has been heated by said first heating device, by means of said heating portion, and by cooling said sheet thus heated by means of said cooling portion.

4. The image forming apparatus according to claim 3, wherein said second heating device comprises a fixing roller, a rotating roller which is arranged at a predetermined distance from said fixing roller, an endless belt which is wrapped around said fixing roller and said rotating roller so as to be rotated therebetween, and a pressure roller which is arranged so as to face said fixing roller and placed in pressure contact with said fixing roller while clamping said endless belt therebetween; and said cooling portion cools said sheet in a portion of said endless belt between said fixing roller and said rotating roller.

5. The image forming apparatus according to claim 1, further comprising:

a cutting device that is arranged at a downstream side of said second heating device in a direction to convey said sheet for cutting said sheet that is heated by said second heating device.

6. The image forming apparatus according to claim 1, wherein said sheet is formed on at least one surface thereof with a layer comprising a thermoplastic resin.

7. An image forming apparatus comprising:

a first heating device which heats a sheet with a toner image formed thereon;

a second heating device which heats said sheet heated by said first heating device;

a first conveying path which conveys said sheet conveyed from said first heating device to said second heating device;

a second conveying path which branches from said first conveying path at a branch portion upstream of said second heating device in said first conveying path for discharging said sheet without conveying it to said second heating device;

a discharge tray to which said sheet being conveyed on said second conveying path is discharged;

a feeding portion which feeds sheets put on a paper refeeding tray; and a feeding conveying path which conveys a sheet fed by said feeding portion to said second heating device, said feeding conveying path having a downstream portion merged into said first conveying path at a location between said first heating device and said second heating device;

an abnormality control portion which issues an abnormality factor that occurs in said second heating device, and a sheet existing between said branch portion and said second heating device in said first conveying path is conveyed upstream of said branch portion, and the sheet thus conveyed upstream of said branch portion is discharged onto said discharge tray through said second conveying path.

8. The image forming apparatus according to claim 7, further comprising:

an annunciation portion which serves to inform that said sheet discharged to said discharge tray should be put on said refeeding tray, when said sheet has been discharged to said discharge tray upon occurrence of said abnormality factor in said second heating device.

9. A sheet heating apparatus comprising:

a first conveying path which conveys a sheet being conveyed from an image forming apparatus main body that includes an image forming portion for forming a toner image on said sheet and a first heating device for heating said sheet having said toner image formed thereon by means of said image forming portion;

a second heating device which heats said sheet being conveyed on said first conveying path;

a second conveying path which branches from said first conveying path at a branch portion upstream of said second heating device in said first conveying path for discharging said sheet without conveying it to said second heating device;

a discharge tray to which said sheet being conveyed on said second conveying path is discharged;

a feeding portion which feeds sheets put on a paper refeeding tray; and a feeding conveying path which conveys a sheet fed by said feeding portion to said second heating device, said feeding conveying path having a downstream portion merged into said first conveying path at a location between said first heating device and said second heating device;

an abnormality control portion which issues an abnormality factor that occurs in said second heating device, and a sheet located upstream of said branch portion is discharged onto said discharge tray through said second conveying path; and after said abnormality factor in said second heating device is removed and said sheet discharged to said discharge tray through said second conveying path is set in said paper refeeding tray, said feeding conveying path feeds the sheet set in said paper refeeding tray to said second heating device.

10. The sheet heating apparatus according to claim 9, further comprising:

an annunciation portion which serves to inform that said sheet discharged to said discharge tray should be put on said refeeding tray, when said sheet has been discharged to said discharge tray upon occurrence of said abnormality factor in said second heating device.

11. The sheet heating apparatus according to claim 9, wherein when an abnormality factor occurs in said second heating device, a sheet existing between said branch portion and said second heating device in said first conveying path is conveyed upstream of said branch portion, and said sheet thus conveyed upstream of said branch portion is discharged onto said discharge tray through said second conveying path.

12. The sheer heating apparatus according to claim 9, wherein said second heating device includes a heating portion and a cooling portion, and provides a luster to the image on said sheet by heating said sheet, which has been heated by said first heating device, by means of said heating portion, and by cooling said sheet thus heated by means of said cooling portion.

13. The sheet heating apparatus according to claim 12, wherein said second heating device comprises a fixing roller, a rotating roller which is arranged at a predetermined distance from said fixing roller, an endless belt which is wrapped around said fixing roller and said rotating roller so as to be rotated therebetween, and a pressure roller which is arranged so as to face said fixing roller and placed in pressure contact with said fixing roller while clamping said endless belt therebetween; and said cooling portion cools said sheet in a portion of said endless belt between said fixing roller and said rotating roller.

* * * * *